US008355907B2

(12) United States Patent
Kapoor et al.

(10) Patent No.: US 8,355,907 B2
(45) Date of Patent: Jan. 15, 2013

(54) METHOD AND APPARATUS FOR PHASE MATCHING FRAMES IN VOCODERS

(75) Inventors: Rohit Kapoor, San Diego, CA (US); Serafin Diaz Spindola, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 959 days.

(21) Appl. No.: 11/192,231

(22) Filed: Jul. 27, 2005

(65) Prior Publication Data

US 2006/0206318 A1 Sep. 14, 2006

Related U.S. Application Data

(60) Provisional application No. 60/660,824, filed on Mar. 11, 2005, provisional application No. 60/662,736, filed on Mar. 16, 2005.

(51) Int. Cl.
*G10L 19/12* (2006.01)

(52) U.S. Cl. ..... 704/221; 704/230; 704/239; 704/241

(58) Field of Classification Search ..... None
See application file for complete search history.

(56) References Cited

U.S. PATENT DOCUMENTS

| | | | |
|---|---|---|---|
| 4,710,960 | A | 12/1987 | Sato |
| 5,283,811 | A | 2/1994 | Chennakeshu et al. |
| 5,317,604 | A | 5/1994 | Osterweil |
| 5,371,853 | A | 12/1994 | Kao et al. |
| 5,440,562 | A | 8/1995 | Cutler |
| 5,490,479 | A | 2/1996 | Shalev |
| 5,586,193 | A | 12/1996 | Ichise et al. |
| 5,640,388 | A | 6/1997 | Woodhead et al. |
| 5,696,557 | A | 12/1997 | Yamashita et al. |
| 5,794,186 | A | 8/1998 | Bergstrom et al. |
| 5,899,966 | A | 5/1999 | Matsumoto et al. |
| 5,929,921 | A | 7/1999 | Taniguchi et al. |
| 5,940,479 | A | 8/1999 | Guy et al. |
| 5,966,187 | A | 10/1999 | Do |
| 6,073,092 | A | 6/2000 | Kwon |

(Continued)

FOREIGN PATENT DOCUMENTS

CN 1432175 A 7/2003

(Continued)

OTHER PUBLICATIONS

"Enhanced Variable Rate Codec, Speech Service Option 3 for Wideband Spread Spectrum Digital Systems," 3GPP2 C.S0014-A (Apr. 2004).

(Continued)

*Primary Examiner* — Leonard Saint Cyr
(74) *Attorney, Agent, or Firm* — Larry J. Moskowitz; Heejong Yoo

(57) ABSTRACT

In one embodiment, the present invention comprises a vocoder having at least one input and at least one output, an encoder comprising a filter having at least one input operably connected to the input of the vocoder and at least one output, a decoder comprising a synthesizer having at least one input operably connected to the at least one output of the encoder, and at least one output operably connected to the at least one output of the vocoder, wherein the decoder comprises a memory and the decoder is adapted to execute instructions stored in the memory comprising phase matching and time-warping a speech frame.

54 Claims, 25 Drawing Sheets

U.S. PATENT DOCUMENTS

| | | | | |
|---|---|---|---|---|
| 6,134,200 | A | 10/2000 | Timmermans | |
| 6,240,386 | B1 | 5/2001 | Thyssen | |
| 6,259,677 | B1 | 7/2001 | Jain | |
| 6,366,880 | B1 | 4/2002 | Ashley | |
| 6,370,125 | B1 | 4/2002 | Belk | |
| 6,377,931 | B1 | 4/2002 | Shlomot | |
| 6,456,964 | B2 | 9/2002 | Manjunath et al. | |
| 6,496,794 | B1 | 12/2002 | Kleider et al. | |
| 6,693,921 | B1 | 2/2004 | Whitfield | |
| 6,785,230 | B1 | 8/2004 | Ogata et al. | |
| 6,813,274 | B1 | 11/2004 | Suzuki et al. | |
| 6,859,460 | B1 | 2/2005 | Chen | |
| 6,922,669 | B2 | 7/2005 | Schalk et al. | |
| 6,925,340 | B1 | 8/2005 | Suito et al. | |
| 6,944,510 | B1 | 9/2005 | Ballesty et al. | |
| 6,996,626 | B1 | 2/2006 | Smith | |
| 7,006,511 | B2 | 2/2006 | Lanzafame et al. | |
| 7,016,970 | B2 | 3/2006 | Harumoto et al. | |
| 7,079,486 | B2 | 7/2006 | Colavito et al. | |
| 7,117,156 | B1 * | 10/2006 | Kapilow | 704/267 |
| 7,126,957 | B1 | 10/2006 | Isukaoalli et al. | |
| 7,158,572 | B2 | 1/2007 | Dunne et al. | |
| 7,263,109 | B2 | 8/2007 | Ternovsky | |
| 7,266,127 | B2 | 9/2007 | Gupta et al. | |
| 7,272,400 | B1 | 9/2007 | Othmer | |
| 7,280,510 | B2 | 10/2007 | Lothia et al. | |
| 7,336,678 | B2 | 2/2008 | Vinnakota et al. | |
| 7,424,026 | B2 | 9/2008 | Mallila | |
| 7,496,086 | B2 | 2/2009 | Eckberg | |
| 7,525,918 | B2 | 4/2009 | LeBlanc et al. | |
| 7,551,671 | B2 | 6/2009 | Tyldesley et al. | |
| 7,817,677 | B2 | 10/2010 | Black et al. | |
| 7,826,441 | B2 | 11/2010 | Black et al. | |
| 7,830,900 | B2 | 11/2010 | Black et al. | |
| 8,155,965 | B2 | 4/2012 | Kapoor et al. | |
| 2002/0016711 | A1 * | 2/2002 | Manjunath et al. | 704/258 |
| 2002/0133334 | A1 | 9/2002 | Coorman et al. | |
| 2002/0133534 | A1 | 9/2002 | Forslow | |
| 2002/0145999 | A1 | 10/2002 | Dzik | |
| 2003/0152093 | A1 | 8/2003 | Gupta et al. | |
| 2003/0152094 | A1 | 8/2003 | Colavito et al. | |
| 2003/0152152 | A1 | 8/2003 | Dunne et al. | |
| 2003/0185186 | A1 | 10/2003 | Tsutsumi et al. | |
| 2003/0202528 | A1 | 10/2003 | Eckberg | |
| 2004/0022262 | A1 | 2/2004 | Vinnakota et al. | |
| 2004/0039464 | A1 | 2/2004 | Virolainen et al. | |
| 2004/0057445 | A1 | 3/2004 | LeBlanc | |
| 2004/0120309 | A1 * | 6/2004 | Kurittu et al. | 370/352 |
| 2004/0141528 | A1 | 7/2004 | LeBlanc et al. | |
| 2004/0156397 | A1 | 8/2004 | Heikkinen et al. | |
| 2004/0179474 | A1 | 9/2004 | Usuda et al. | |
| 2004/0204935 | A1 | 10/2004 | Anandakumar et al. | |
| 2005/0007952 | A1 | 1/2005 | Scott | |
| 2005/0036459 | A1 | 2/2005 | Kexys et al. | |
| 2005/0058145 | A1 | 3/2005 | Florencio et al. | |
| 2005/0089003 | A1 | 4/2005 | Proctor et al. | |
| 2005/0180405 | A1 | 8/2005 | Bastin | |
| 2005/0228648 | A1 * | 10/2005 | Heikkinen | 704/205 |
| 2005/0243846 | A1 | 11/2005 | Mallila | |
| 2006/0050743 | A1 | 3/2006 | Black et al. | |
| 2006/0077994 | A1 | 4/2006 | Spindola et al. | |
| 2006/0171419 | A1 | 8/2006 | Spindola et al. | |
| 2006/0184861 | A1 | 8/2006 | Sun et al. | |
| 2006/0187970 | A1 | 8/2006 | Lee et al. | |
| 2006/0277042 | A1 | 12/2006 | Vos et al. | |
| 2007/0206645 | A1 | 9/2007 | Sundqvist et al. | |
| 2011/0222423 | A1 | 9/2011 | Spindola et al. | |

FOREIGN PATENT DOCUMENTS

| | | | |
|---|---|---|---|
| EP | 0707398 | | 4/1996 |
| EP | 0731448 | A2 | 9/1996 |
| EP | 1088303 | A1 | 4/2001 |
| EP | 1221694 | | 7/2002 |
| EP | 1278353 | | 12/2003 |
| EP | 1536582 | A2 | 1/2005 |
| JP | 56-43800 | | 10/1981 |
| JP | 57158247 | A | 9/1982 |
| JP | 61-156949 | | 7/1986 |
| JP | 64029141 | | 1/1989 |
| JP | 02081538 | | 3/1990 |
| JP | 2502776 | | 8/1990 |
| JP | 04-113744 | | 4/1992 |
| JP | 04150241 | | 5/1992 |
| JP | 8130544 | A | 5/1996 |
| JP | 08256131 | | 10/1996 |
| JP | 9127995 | A | 5/1997 |
| JP | 09261613 | | 10/1997 |
| JP | 10-190735 | | 7/1998 |
| JP | 2001045067 | | 2/2001 |
| JP | 2001134300 | A | 5/2001 |
| JP | 2003532149 | | 10/2003 |
| JP | 2004153618 | A | 5/2004 |
| JP | 2004-266724 | | 9/2004 |
| JP | 2004-282692 | | 10/2004 |
| JP | 2005-057504 | | 3/2005 |
| JP | 2005521907 | T | 7/2005 |
| JP | 2006-050488 | | 2/2006 |
| KR | 20040050813 | | 6/2004 |
| RU | 2073913 | | 2/1997 |
| RU | 2118058 | | 8/1998 |
| TW | 504937 | B | 10/2002 |
| TW | 515168 | B | 12/2002 |
| WO | 9222891 | | 12/1992 |
| WO | 9522819 | | 8/1995 |
| WO | 9710586 | | 3/1997 |
| WO | 8807297 | | 9/1998 |
| WO | 0024144 | | 4/2000 |
| WO | 0033503 | | 6/2000 |
| WO | 0042749 | | 7/2000 |
| WO | WO0055829 | | 9/2000 |
| WO | WO0063885 | A1 | 10/2000 |
| WO | WO0176162 | A1 | 10/2001 |
| WO | 0182289 | | 11/2001 |
| WO | WO0182293 | | 11/2001 |
| WO | WO03083834 | A1 | 10/2003 |
| WO | WO03090209 | A1 | 10/2003 |
| WO | 2006099534 | | 9/2006 |

OTHER PUBLICATIONS

Boku et al., "Structures and Network Performance of the Ultra-fast Optical Packet Switching Ring Network", Technical Report of IEICE, Japan, The Institute of Electronics, Information and Communication Engineers, Jul. 26, 2002, vol. 102, No. 257, CS2002-56.

Benaissa et al., "An algorithm for delay adjustment for interactive audio applications in mobile ad hoc networks," Proceedings of the Seventh International Symposium on Computers and Communications, Jul. 2002, pp. 524-529.

Choudhury, et al., "Design and Analysis of Optimal Adaptive Dejitter Buffers," Computer Communications, Elsevier Science Publishers BV, vol. 27, No. 6, Apr. 2004, pp. 529-537.

E. Moulines et al.: "Time-Domain and Frequency-Domain Techniques for Prosodic Modification of Speech," 1995 Eisevier Science B.V., (Chapter 15), pp. 519-555, XP002366713.

Goldenstein et al., "Time Warping of Audio Signals," Computer Graphics International Proceedings, Jun. 18, 1999, pp. 1-7.

Liang et al., "Adaptive playout scheduling using time-scale modification in packet voice communications," Acoustics, Speech, and Signal Processing, 2001, Proceedings (ICASSP-01) 2001 IEEE International Conference, vol. 3, May 7-11, 2001, pp. 1445-1448.

Verhelst et al.: "An overlap-add technique based on waveform similarity (WSOLA) for high quaiity time-scale modification of speech," IEEE International Conference on Acoustics, Speech, and Signal Processing, vol. 2, Apr. 1993, pp. 554-557.

International Search Report—PCT/US06/009477—International Search Authority, European Patent Office—Jul. 16, 2006.

Written Opinion—PCT/US06/009477—Internationai Search Authority, European Patent Office—Jul. 6, 2006.

International Preliminary Report on Patentability—PCT/US06/009477—The International Bureau of WIPO, Geneva, Switzerland—Sep. 12, 2007.

Bellavista, Paolo; Corradi, Antonio; Giannelli, Carlo: "Adaptive Buffering-based on Handoff Prediction for Wireless Internet Continuous Services", [Online] Sep. 23, 2005, pp. 1-12, XP002609715, Retrieved from the Internet : URL: http://citeseerx. ist .psu.edu/viewdoc/summary?doi=10.1.1.62.6005>.

Vatn, Jon-Olov: "Thesis proposal: Supporting real-time services to mobile Internet hosts". [Online] Jun. 5, 2002, pp. 1-21, XP002609716, Retrieved from the Internet: URL:http://web. it. kth. se/{maguire/vatn/res earch/thesis-proposal-updated. pdf> [retrieved on Nov. 15, 2010].

Sen S et al: "Proxy prefix caching for multimedia streams", INFOCOM '99. Eighteenth Annual Joint Conference of the IEEE Computer and Communications Societies. Proceedings. IEEE New York, NY, USA Mar. 21-25, 1999, Piscataway, NJ, USA,IEEE, US, vol. 3, Mar. 21, 1999, pp. 1310-1319, XP010323883, ISBN: 978-0-7803-5417-3.

Taiwan Search Report—TW095108247—TIPO—Sep. 26, 2012.

* cited by examiner $$a)\,OutSegment[i] = \frac{(Segment1(i) * (WindowSize - i) + (Segment2(i) * i)}{WindowSize}$$

$$b)\,OutSegment[i] = \frac{(Segment2(i) * (WindowSize - i) + (Segment1(i) * i)}{WindowSize}$$

i=0..WindowSize-1 WindowSize=RWindowSize

FIG. 22

METHOD AND APPARATUS FOR PHASE MATCHING FRAMES IN VOCODERS

CLAIM OF PRIORITY UNDER 35 U.S.C. §119

This application claims benefit of U.S. Provisional Application No. 60/662,736 entitled "Method and Apparatus for Phase Matching Frames in Vocoders," filed Mar. 16, 2005, and U.S. Provisional Application No. 60/660,824 entitled "Time Warping Frames Inside the Vocoder by Modifying the Residual," filed Mar. 11, 2005, the entire disclosure of these applications being considered part of the disclosure of this application and hereby incorporated by reference.

BACKGROUND

1. Field

The present invention relates generally to a method to correct artifacts induced in voice decoders. In a packet-switched system, a de-jitter buffer is used to store frames and subsequently deliver them in sequence. The method of the de-jitter buffer may at times insert erasures in between two frames of consecutive sequence numbers. This can in some cases cause an erasure(s) to be inserted between two consecutive frames and in some other cases cause some frames to be skipped, causing the encoder and decoder to be out of sync in phase. As a result, artifacts may be introduced into the decoder output signal.

2. Background

The present invention comprises an apparatus and method to prevent or minimize artifacts in decoded speech when a frame is decoded after the decoding of one or more erasures.

SUMMARY OF THE INVENTION

In view of the above, the described features of the present invention generally relate to one or more improved systems, methods and/or apparatuses for communicating speech.

In one embodiment, the present invention comprises a method of minimizing artifacts in speech comprising the step of phase matching a frame.

In another embodiment, the step of phase matching a frame comprises changing the number of speech samples of the frame to match the phase of the encoder and decoder.

In another embodiment, the present invention comprises the step of time-warping a frame to increase the number of speech samples of the frame, if the step of phase matching has decreased the number of speech samples.

In another embodiment, the speech is encoded using code-excited linear prediction encoding and the step of time-warping comprises estimating pitch delay, dividing a speech frame into pitch periods, wherein boundaries of the pitch periods are determined using the pitch delay at various points in the speech frame, and adding pitch periods using overlap-add techniques if the speech residual signal is to be expanded.

In another embodiment, the speech is encoded using prototype pitch period encoding and the step of time-warping comprises estimating at least one pitch period, interpolating the at least one pitch period, adding the at least one pitch period when expanding the residual speech signal.

In another embodiment, the present invention comprises a vocoder having at least one input and at least one output, an encoder including a filter having at least one input operably connected to the input of the vocoder and at least one output, a decoder including a synthesizer having at least one input operably connected to the at least one output of said encoder and at least one output operably connected to the at least one output of said vocoder, wherein the decoder comprises a memory and the decoder is adapted to execute instructions stored in the memory comprising phase matching and time-warping a speech frame.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

FIG. 22 contains two equations used in the add-overlap method; and

DETAILED DESCRIPTION

Section I: Removing Artifacts

The word "illustrative" is used herein to mean "serving as an example, instance, or illustration." Any embodiment described herein as "illustrative" is not necessarily to be construed as preferred or advantageous over other embodiments.

The present method and apparatus uses phase matching to correct discontinuities in the decoded signal when the encoder and decoder may be out of sync in signal phase. This method and apparatus also uses phase-matched future frames to conceal erasures. The benefit of this method and apparatus can be significant, particularly in the case of double erasures, which are known to cause appreciable degradation of voice quality.

Speech Artifact Caused Due to Repeating Frame after its Erased Version

Figure 1:
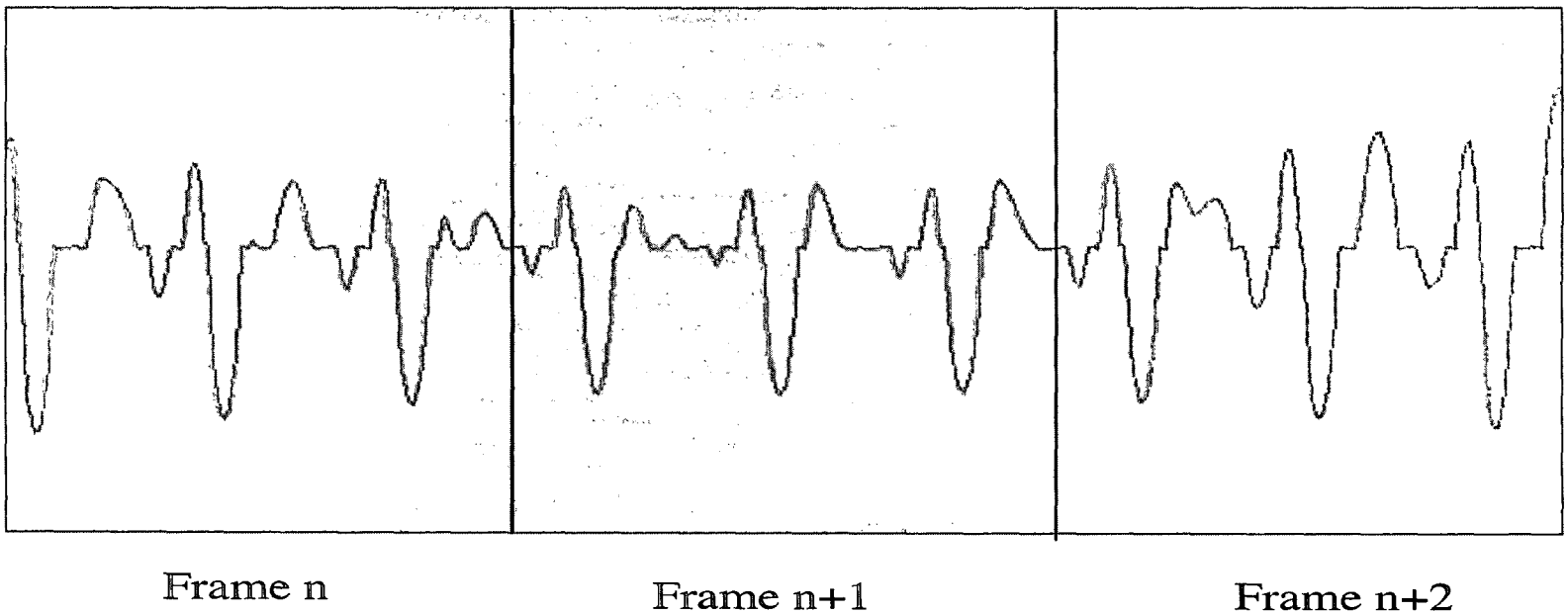
FIG. 1 is a plot of 3 consecutive voice frames showing continuity of signal.

It is desirable to maintain the phase continuity of the signal from one voice frame 20 to the next voice frame 20. To maintain the continuity of the signal from one voice frame 20 to another, voice decoders 206, in general, receive frames in sequence. FIG. 1 shows an example of this.

In a packet-switched system, the voice decoder 206 uses a de-jitter buffer 209 to store speech frames and subsequently deliver them in sequence. If a frame is not received by its playback time, the de-jitter buffer 209 may at times insert erasures 240 in place of the missing frame 20 in between two frames 20 of consecutive sequence numbers. Thus, erasures 240 may be substituted by the receiver 202 when a frame 20 is expected, but not received.

Figure 2A:
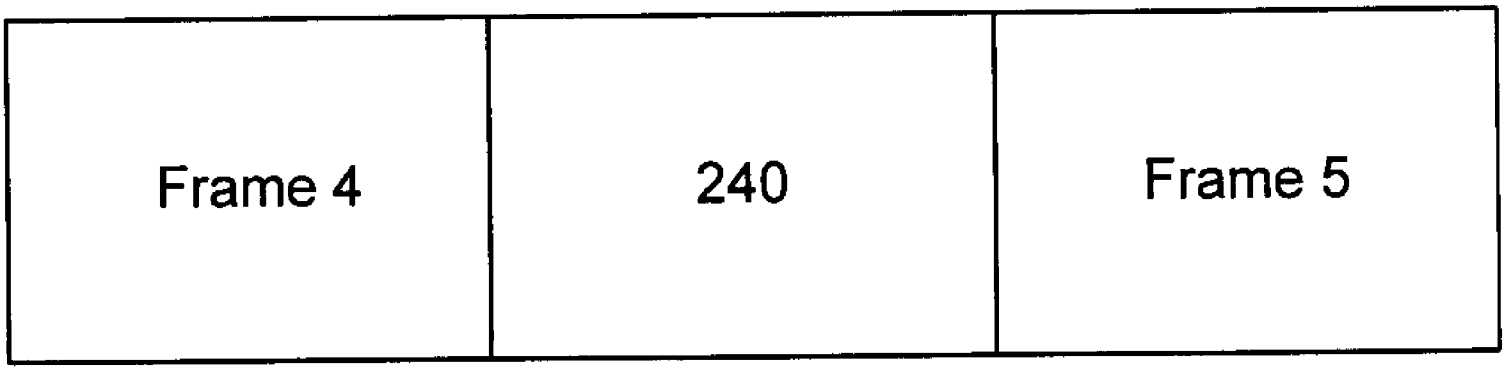
FIG. 2A illustrates a frame being repeated after its erasure.

An example of this is shown in FIG. 2A. In FIG. 2A, the previous frame 20 sent to the voice decoder 206 was frame number 4. Frame 5 was the next frame to be sent to the decoder 206, but was not present in the de-jitter buffer 209. Consequently, this caused an erasure 240 to be sent to the decoder 206 in place of frame 5. Thus, since no frames 20 were present after frame 4, an erasure 240 was played. After this, frame number 5 was received by the de-jitter buffer 209 and it was sent as the next frame 20 to the decoder 206.

However, the phase at the end of the erasure 240 is in general different than the phase at the end of frame 4. Consequently, the decoding of frame number 5 after the erasure 240, as opposed to after frame 4, can cause a discontinuity in phase, shown as point D in FIG. 2B. Essentially, when the decoder 206 constructs the erasure 240 (after frame 4), it extends the waveform by 160 Pulse Code Modulation (PCM) samples assuming, in this embodiment, that there are 160 PCM samples per speech frame. Therefore, each speech frame 20 will change the phase by 160 PCM samples/pitch period, where pitch is the fundamental frequency of a speaker's voice. The pitch period 100 may vary from approximately 30 PCM samples for a high pitched female voice to 120 PCM samples for a male voice. In one example, if the phase at the end of frame 4 is labeled phase1, and the pitch period 100 (assumed to not change by much; if pitch period is changing, then the pitch period in Equation 1 can be replaced by the average pitch period) is labeled PP, then the phase in radians at the end of the erasure 240, phase2, would be equal to:

$$\text{phase2}=\text{phase1(in radians)}+(160/PP)\text{multiplied by } 2\pi \qquad \text{equation 1}$$

where speech frames have 160 PCM samples. If 160 is a multiple of the pitch period 100, then the phase, phase2, at the end of the erasure 240, would be equal to phase1.

However, where 160 is not a multiple of PP, phase2 is not equal to phase1. This means that the encoder 204 and decoder 206 may be out of sync with respect to their phases.

Another way to describe this phase relationship is through the use of modulo arithmetic shown in the following equation where "mod" represents modulo. Modulo arithmetic is a system of arithmetic for integers where numbers wrap around after they reach a certain value, i.e., the modulus. Using modulo arithmetic, the phase in radians at the end of the erasure 240, phase2, would be equal to:

$$\text{phase2}=(\text{phase1}+(160 \text{ samples mod } PP)/PP \text{ multiplied by } 2\pi)\text{mod } 2\pi \qquad \text{equation 2}$$

For example, when the pitch period 100, PP=50 PCM samples, and the frame has 160 PCM samples, phase2=phase1+(160 mod 50)/50 times 2π=phase1+10/50*2π. (160 mod 50=10 because 10 is the remainder after dividing 160 by the modulus 50. That is, every time a multiple of 50 is reached, the number wraps around leaving a remainder of 10). This means that the difference in phase between the end of frame 4 and the beginning of frame 5 is 0.4π radians.

Figure 2B:
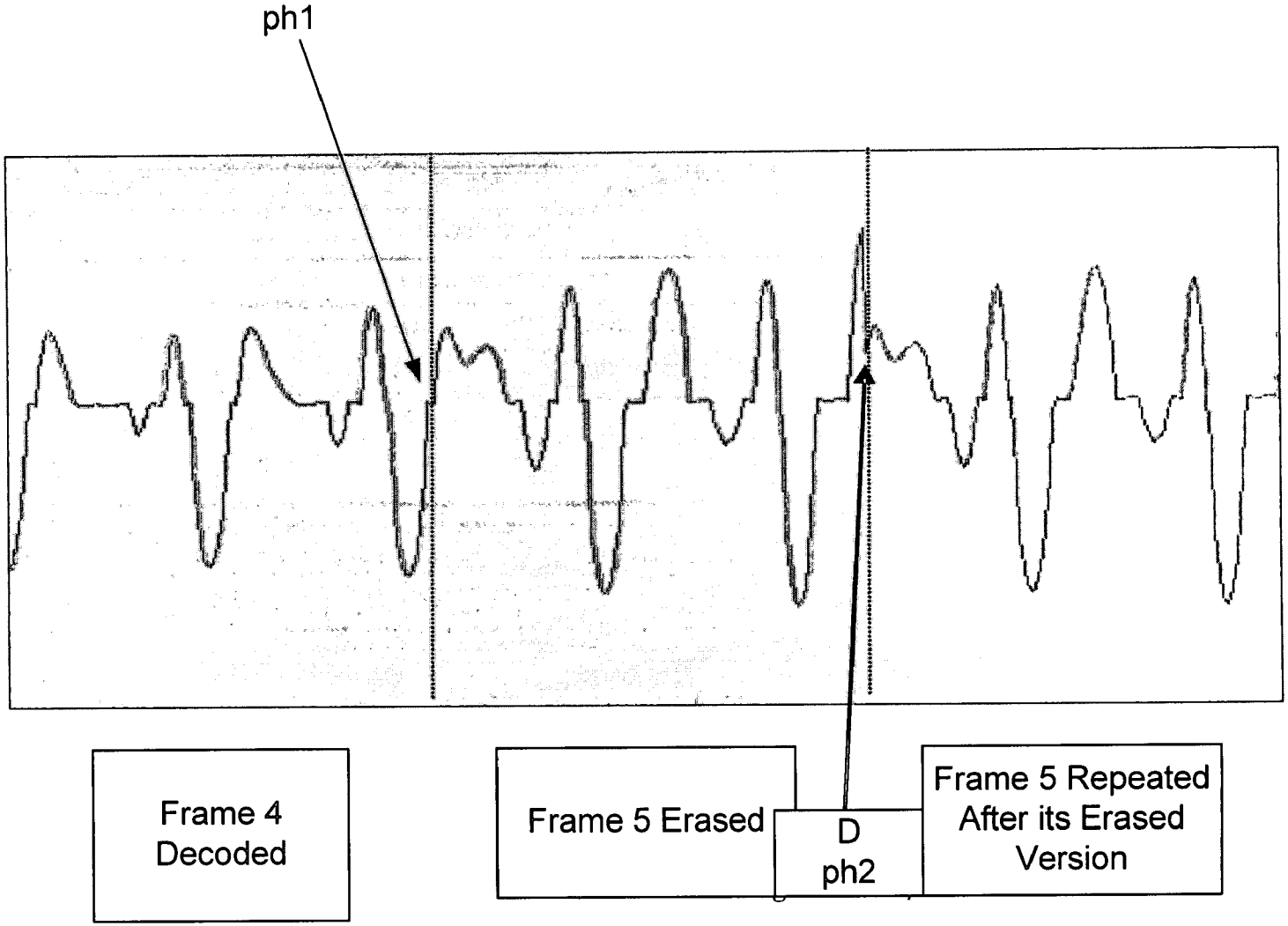
FIG. 2B illustrates a discontinuity in phase, shown as point D, caused by repeating of frame after its erasure.

Returning to FIG. 2B, frame 5 has been encoded assuming that its phase starts where the phase of frame 4 ends, i.e., with a starting phase of phase1. But, the decoder 206 will decode frame 5 with a starting phase of phase2, as shown in FIG. 2B (note here that encoder/decoder have memories which are used for compressing the speech signal; the phase of the encoder/decoder is the phase of these memories at the encoder/decoder). This may cause artifacts like clicks, pops, etc. in the speech signal. The nature of this artifact depends on the type of vocoder 70 used. For example, a phase discontinuity may introduce a slightly metallic sound at the discontinuity.

In FIG. 2B, it can be argued that the de-jitter buffer 209, which keeps track of frame 20 numbers and ensures that the frames 20 are sent in proper sequential order, need not send frame 5 to the decoder 206 once an erasure 240 has been constructed in the place of frame 5. However, there are two advantages to sending such a frame 20 to the decoder 206. In general, the erasure's 240 reconstruction in the decoder 206 is not perfect. The voice frame 20 may contain a segment of the speech which may not have been reconstructed perfectly by the erasure 240. Thus, playing frame 5 ensures that speech segments 110 are not missing. Also, if such a frame 20 is not sent to the decoder 206, there is a chance that the next frame 20 may not be present in the de-jitter buffer 209. This can cause another erasure 240 and lead to a double erasure 240 (i.e., two consecutive erasures 240). This is problematic because multiple erasures 240 can cause much more degradation in quality than single erasures 240.

As shown above, a frame 20 may be decoded immediately after its erased version has already been decoded, causing the encoder 204 and decoder 206 to be out of sync in phase. This present method and apparatus seeks to correct small artifacts introduced in voice decoders 206 due to the encoder 204 and decoder 206 being out of sync in phase.

Phase Matching

The technique of phase matching, described in this section, can be used to bring decoder memory 207 in sync with the encoder memory 205. As representative examples, the present method and apparatus may be used with either a Code-Excited Linear Prediction (CELP) vocoder 70 or a Prototype Pitch Period (PPP) vocoder 70. Note that the use of phase matching in the context of CELP or PPP vocoders is presented only as an example. Phase matching may be similarly applied to other vocoders too. Before presenting the solution in the context of specific CELP or PPP vocoder 70 embodiments, the phase matching method of the present method and apparatus will be described. Fixing the discontinuity caused by the erasure 240 as shown in FIG. 2B can be achieved by starting the decoding the frame 20 after the erasure 240 (i.e., frame 5 in FIG. 2B) not at the beginning, but at a certain offset from the beginning of the frame 20. Thus, the first few samples (or some information of these) of the frame 20 are discarded such that the first sample after discarding has the same phase as that at the end of the preceding frame 20 (i.e., frame 4 in FIG. 2B) erasure 240. This method is applied in slightly different ways to CELP or PPP decoders 206. This is further described below.

CELP Vocoder

Figure 3:
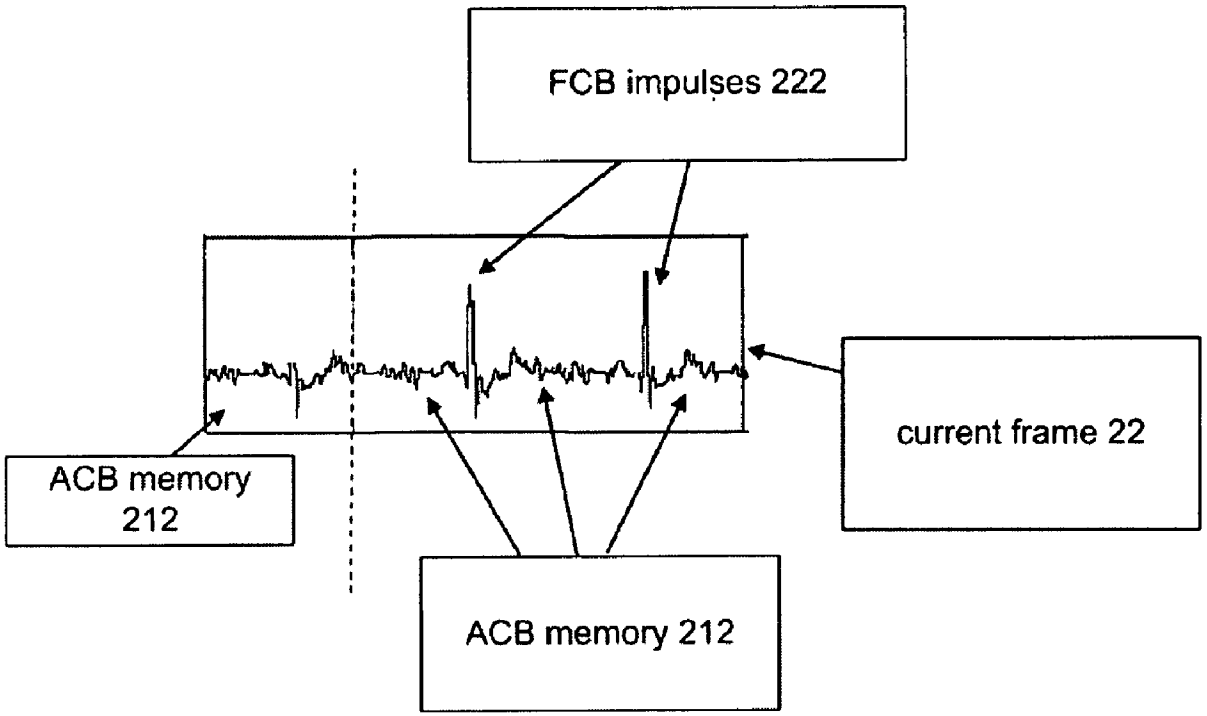
FIG. 3 illustrates combining ACB and FCB information to create a CELP decoded frame.

A CELP-encoded voice frame 20 contains two different kinds of information which are combined to create the decoded PCM samples, a voiced (periodic part) and an unvoiced (non-periodic part). The voiced part consists of an Adaptive Codebook (ACB) 210 and its gain. This part combined with the pitch period 100 can be used to extend the previous frame's 20 ACB memory with the appropriate ACB 210 gain applied. The non-voiced part consists of a fixed codebook (FCB) 220 which is information about impulses to be applied in the signal 10 at various points. FIG. 3 shows how an ACB 210 and a FCB 220 can be combined to create the CELP decoded frame. To the left of the dotted line in FIG. 3, ACB memory 212 is plotted. To the right of the dotted line, the ACB part of the signal extended using ACB memory 212 is plotted along with FCB impulses 222 for the current decoded frame 22.

Figure 4A:
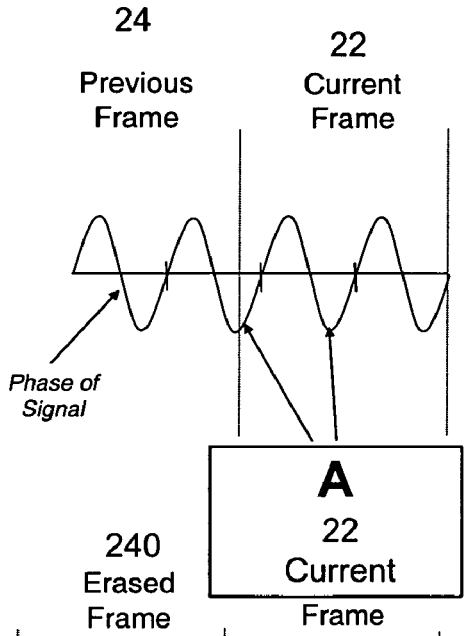
FIG. 4A depicts FCB impulses inserted at the correct phase.
Figure 4B:
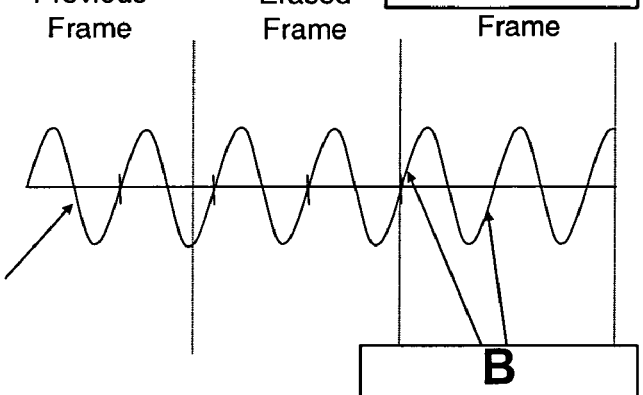
FIG. 4B depicts FCB impulses inserted at an incorrect phase due to the frame being repeated after an erasure.

If the phase of the previous frame's 20 last sample is different from that of the current frame's 20 first sample (as is in the case under consideration), the ACB 210 and FCB 220 will be mismatched, i.e., there is a phase discontinuity where the previous frame 24 is frame 4 and the current frame 22 is frame 5. This is shown in FIG. 4B where at point B, FCB impulses 222 are inserted at incorrect phases. The mismatch between the FCB 220 and ACB 210 means that the FCB 220 impulses 222 are applied at wrong phases in the signal 10. This leads to a metallic kind of sound when the signal 10 is decoded, i.e., an artifact. Note that FIG. 4A shows the case when the FCB 220 and ACB 210 are matched, i.e., when the phase of the previous frame's 24 last sample is the same as that of the current frame's 20 first sample.

Solution

To solve this problem, the present phase matching method matches the FCB 220 with the appropriate phase in the signal 10. The steps of this method comprise:

finding the number of samples, ΔN, in the current frame 22 after which the phase is similar to the one at which the previous frame 24 ended; and shifting the FCB indices by ΔN samples such that ACB 210 and FCB 220 are now matched.

Figure 4C:
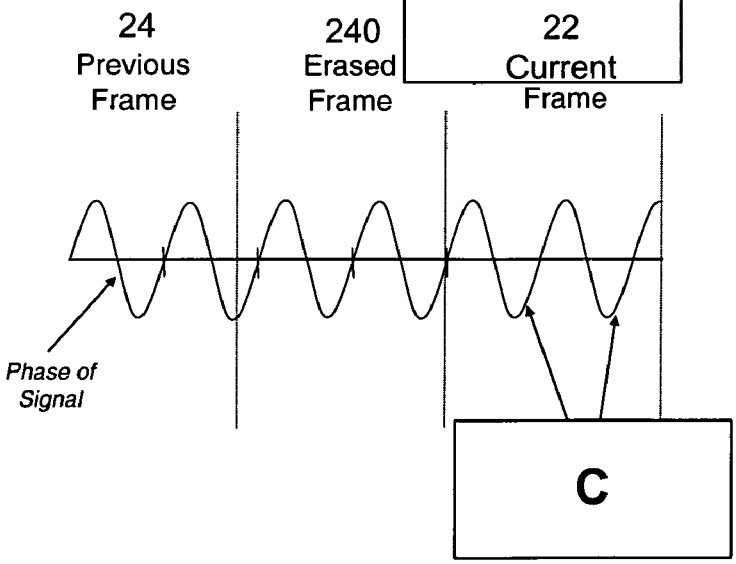
FIG. 4C illustrates shifting FCB impulses to insert them at a correct phase.

The results of the above two steps are shown in FIG. 4C, at point C where FCB impulses 222 are shifted and inserted at correct phases.

The above method may cause smaller than 160 samples for the frame 20 to be generated, since the first few FCB 220 indices have been discarded. The samples can then be time-warped (i.e., expanded outside the decoder or inside the decoder 206 using the methods as disclosed in provisional patent application "Time Warping Frames inside the Vocoder by Modifying the Residual," filed Mar. 11, 2005, herein incorporated by reference and attached in SECTION II—TIME WARPING) to create a larger number of samples.

Prototype Pitch Period (PPP) Vocoder

A PPP-encoded frame 20 contains information to extend the previous frame's 20 signal by 160 samples by interpolating between the previous 24 and the current frame 22. The main difference between CELP and PPP is that PPP encodes only periodic information.

Figure 5A:
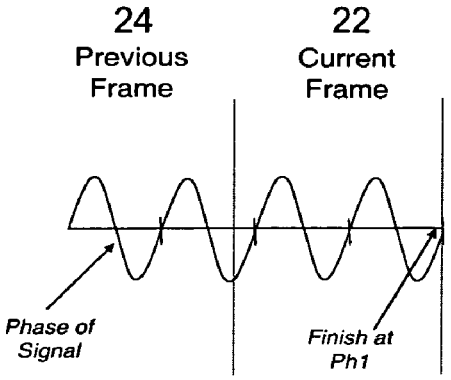
FIG. 5A illustrates how PPP extends the previous frame's signal to create 160 more samples.
Figure 5B:
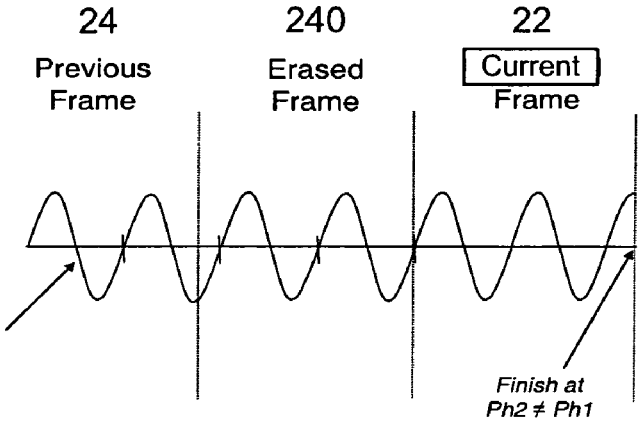
FIG. 5B illustrates that the finishing phase for a current frame is incorrect due to an erased frame.

FIG. 5A shows how PPP extends the previous frame's 24 signal to create 160 more samples. In FIG. 5A, the current frame 22 finishes at phase ph1. As shown in FIG. 5B, the previous frame 24 is followed by an erasure 240 and then the current frame 22. If the starting phase for the current frame 22 is incorrect (as is in the case shown in FIG. 5B), then the current frame 22 will end at a different phase than the one shown in FIG. 5A. In FIG. 5B, due to the frame 20 being played after the erasure 240, the current frame 22 finishes at phase ph2≠ph1. This will then cause a discontinuity with the frame 20 following the current frame 22 since the next frame 20 will have been encoded assuming the finishing phase of the current frame 22 in FIG. 5A is equal to phase1, ph1.

Solution

Figure 5C:
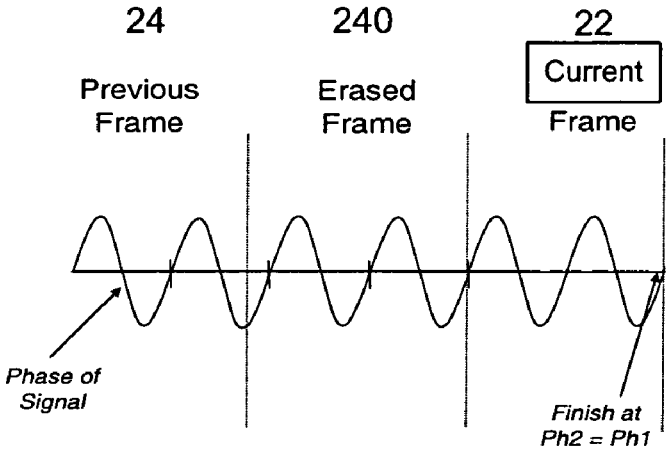
FIG. 5C depicts an embodiment where a smaller number of samples are generated from the current frame such that the current frame finishes at phase ph2=ph1.

This problem can be corrected by generating N=160−x samples from the current frame 22, such that the phase at the end of the current frame 22 matches with the phase at the end of the previous erasure-reconstructed frame 240. (It is assumed that the frame length=160 PCM samples). This is shown in FIG. 5C where a smaller number of samples are generated from the current frame 22 such that the current frame 22 finishes at phase ph2=ph1. In effect, x samples are removed from the end of the current frame 22.

If it is desirable to prevent the number of samples from being less than 160, N=160−x+PP samples can be generated from the current frame 22, where it is assumed that there are 160 PCM samples in the frame. It is straightforward to generate a variable number of samples from a PPP decoder 206 since the synthesis process just extends or interpolates the previous signal 10.

Concealing Erasures Using Phase Matching and Warping

In data networks such as EV-DO, voice frames 20 may at times be either dropped (physical layer) or severely delayed, causing the de-jitter buffer 209 to introduce erasures 240 into the decoder 206. Even though vocoders 70 typically use erasure concealment methods, the degradation in voice quality, particularly under high erasure rate, may be quite noticeable. Significant voice quality degradation may be observed particularly when multiple consecutive erasures 240 occur, since vocoder 70 erasure 240 concealment methods typically tend to "fade" the voice signal 10 when multiple consecutive erasures occur.

The de-jitter buffer 209 is used in data networks such as EV-DO to remove jitter from arrival times of voice frames 20 and present a streamlined input to the decoder 206. The de-jitter buffer 209 works by buffering some frames 20 and then providing them to the decoder 206 in a jitter-free manner. This presents an opportunity to enhance the erasure 240 concealment method at the decoder 206 since at times, some 'future' frames 26 (compared to the 'current' frame 22 being decoded) may be present in the de-jitter buffer 209. Thus, if a frame 20 needs to be erased (if it was dropped at the physical layer or arrived too late), the decoder 206 can use the future frame 26 to perform better erasure 240 concealment.

Figure 6:
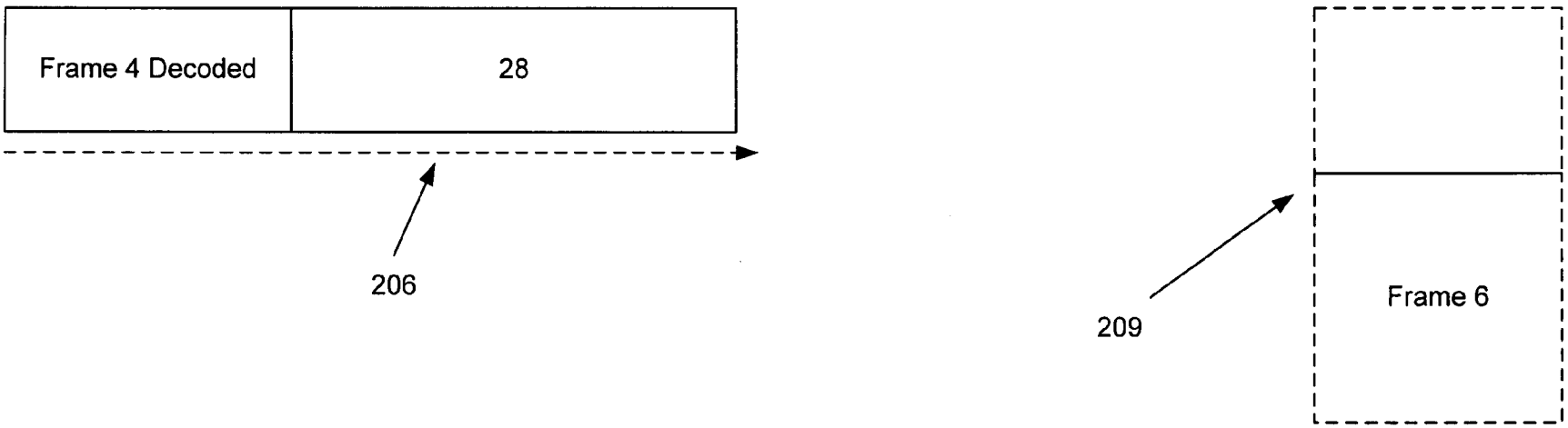
FIG. 6 illustrates warping frame 6 to fill the erasure of frame 5.

Information from future frame 26 can be used to conceal erasures 240. In one embodiment, the present method and apparatus comprise time-warping (expanding) the future frame 26 to fill the 'hole' created by the erased frame 20 and phase matching the future frame 26 to ensure a continuous signal 10. Consider the situation shown in FIG. 6, where voice frame 4 has been decoded. The current voice frame 5 is not available at the dejitter buffer 209, but the next voice frame 6 is present. The decoder 206 can warp voice frame 6 to conceal frame 5, instead of playing out an erasure 240. That is, frame 6 is decoded and time-warped to fill the space of frame 5. This is shown as reference numeral 28 in FIG. 6.

Figure 7:
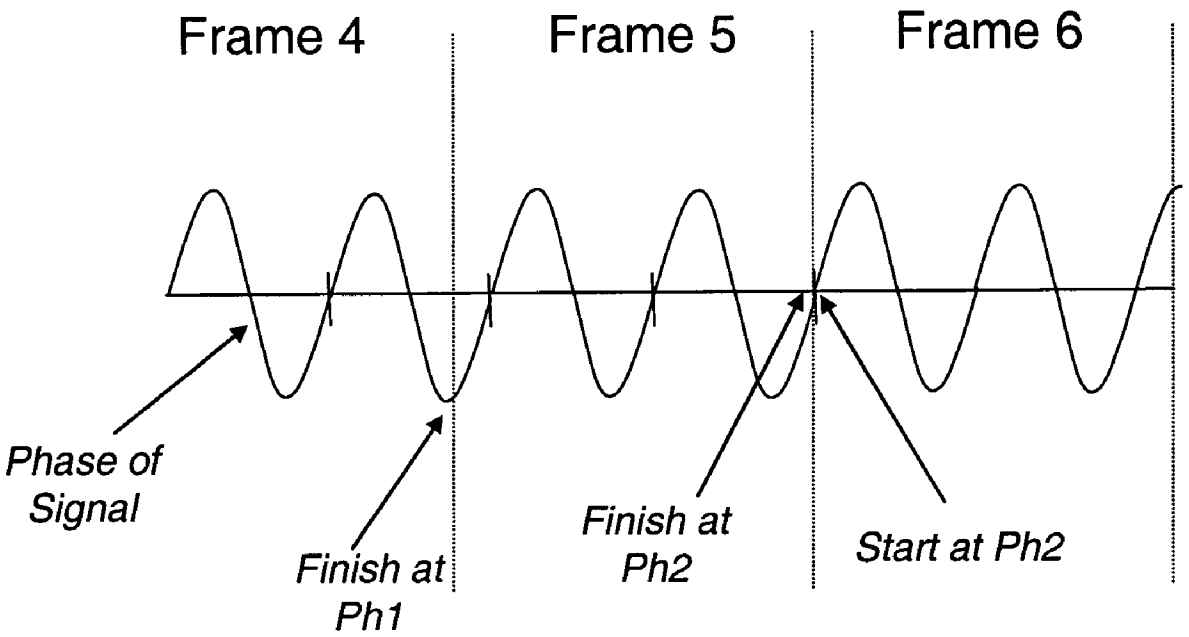
FIG. 7 illustrates the phase difference between the end of frame 4 and the beginning of frame 6.

This involves the following two steps:

1) Matching the phase: The end of a voice frame 20 leaves the voice signal 10 in a particular phase. As shown in FIG. 7, the phase at the end of frame 4 is ph1. Voice frame 6 has been encoded with a starting phase of ph2, which is basically the phase at the end of voice frame 5, in general, ph1≠ph2. Thus, the decoding of frame 6 needs to start at an offset such that the starting phase becomes equal to ph1.

To match the starting phase of frame 6, ph2, to the finish phase of frame 4, ph1, the first few samples of frame 6 are discarded such that the first sample after discarding has the same phased as that at the end of frame 4. The method to do this phase matching was described earlier, examples of how phase matching is used for CELP and PPP vocoders 70 were also described.

2) Time-Warping (Expanding) the Frame: Once frame 6 has been phase-matched with frame 4, frame 6 is warped to produce samples to fill the 'hole' of frame 5 (i.e., to produce close to 320 PCM samples). Time-warping methods for CELP and PPP vocoders 70 as described later may be used to time warp the frames 20.

In one embodiment of Phase Matching, the de-jitter buffer 209 keeps track of two variables, phase offset 136 and run length 138. The phase offset 136 is equal to the difference between the number of frames the decoder 206 has decoded and the number of frames the encoder 204 has encoded, starting from the last frame that was not decoded as an erasure. Run length 138 is defined as the number of consecutive erasures 240 the decoder 206 has decoded immediately prior to the decoding of the current frame 22. These two variables are passed as input to the decoder 206.

Figure 8:
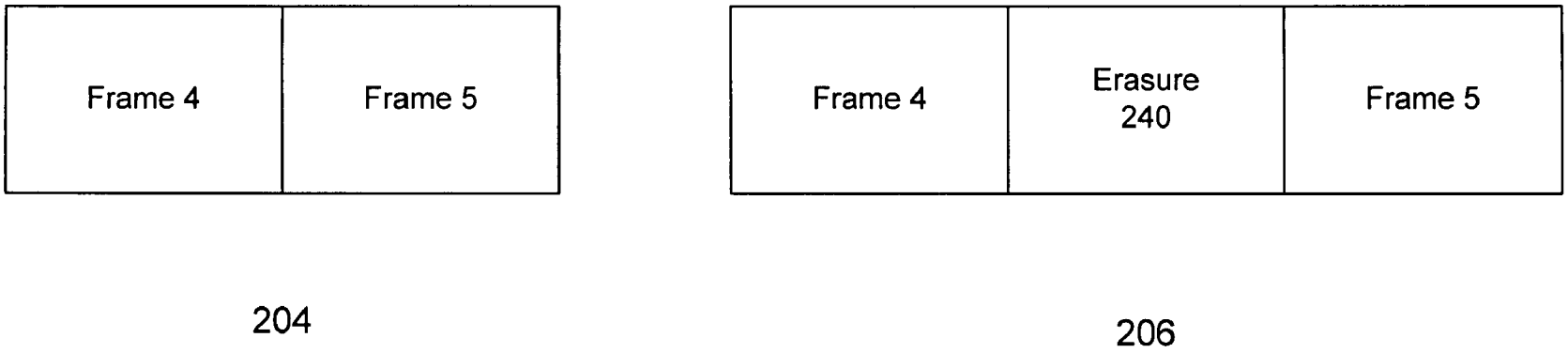
FIG. 8 illustrates an embodiment in which the decoder plays an erasure after decoding frame 4 and then is ready to decode frame 5.

FIG. 8 illustrates an embodiment in which the decoder 206 plays an erasure 240 after decoding packet 4. After the erasure 240, it is ready to decode packet 5. Assume that the phases of the encoder 204 and decoder 206 were in sync at the end of packet 4 with phase equal to Phase_Start. Also, through the rest of this document, we assume that the vocoder produces 160 samples per frame (also for erased frames).

The states of the encoder 204 and decoder 206 are shown in FIG. 8. The encoder's 204 phase at the beginning of packet 5=Enc_Phase=Phase_Start. The decoder's 206 phase at the beginning of packet 5=Dec_Phase=Phase_Start+(160 mod Delay (4))/Delay (4), where there are 160 samples per frame, Delay (4) is the pitch delay (in PCM samples) of frame 4, and it is assumed that the erasure 240 has a pitch delay equal to the pitch delay of frame 4. The phase offset (136)=1 and the run length (138)=1.

Figure 9:
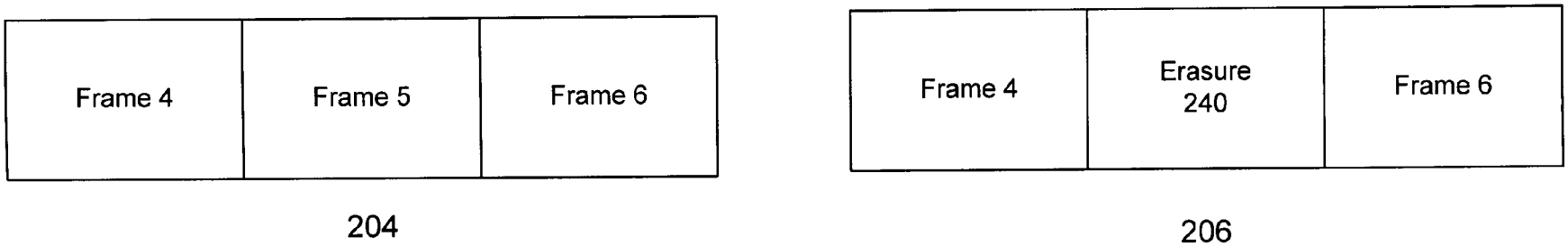
FIG. 9 illustrates an embodiment in which the decoder plays an erasure after decoding frame 4 and then is ready to decode frame 6.

In another embodiment shown in FIG. 9, the decoder 206 plays an erasure 240 after decoding frame 4. After the erasure 240, it is ready to decode frame 6. Assume that the phases of the encoder 204 and decoder 206 were in sync at the end of frame 4 with phase equal to Phase_Start. The states of the encoder 204 and decoder 206 are shown in FIG. 9. In the embodiment illustrated in FIG. 9, the encoder's 204 phase at the beginning of packet 6=Enc_Phase=Phase_Start+(160 mod Delay (5))/Delay (5).

The decoder's phase at the beginning of packet 6=Dec_Phase=Phase_Start+(160 mod Delay (4))/Delay (4), where there are 160 samples per frame, Delay (4) is the pitch delay (in PCM samples) of frame 4, and it is assumed that the erasure 240 has a pitch delay equal to the pitch delay of frame 4. In this case, Phase Offset (136)=0 and Run Length (138)=1.

Figure 10:
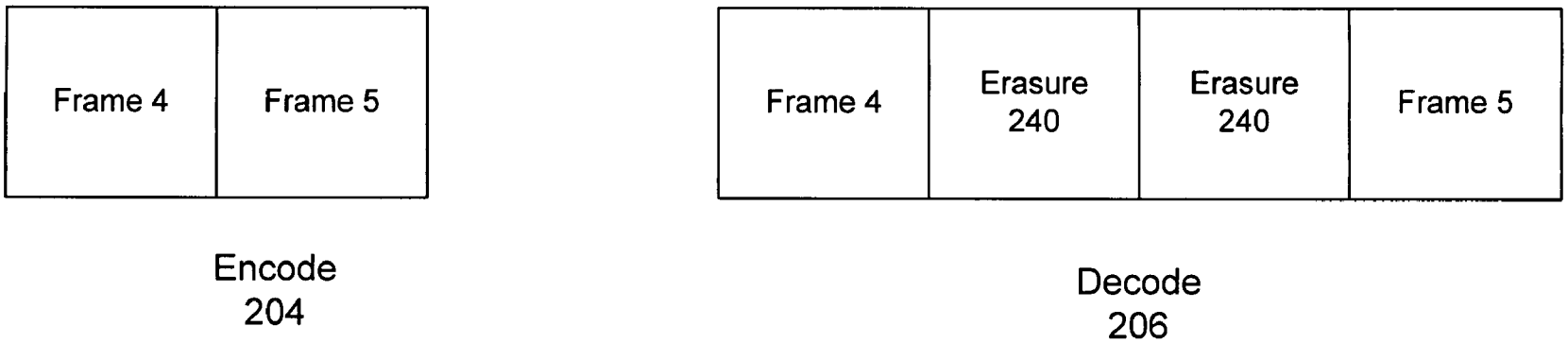
FIG. 10 illustrates an embodiment in which the decoder decodes two erasures after decoding frame 4 and is ready to decode frame 5.

In another embodiment shown in FIG. 10, the decoder 206 decodes two erasures 240 after decoding frame 4. After the erasures 240, it is ready to decode frame 5. Assume that the phases of the encoder 204 and decoder 206 were in sync at the end of frame 4 with phase equal to Phase_Start.

The states of the encoder 204 and decoder 206 are shown in FIG. 10. In this case, the encoder's 204 phase at the beginning of frame 6=Enc_Phase=Phase_Start. The decoder's 206 phase at the beginning of frame 6=Dec_Phase=Phase_Start+((160 mod Delay (4))*2)/Delay (4), where it is assumed each erasure 240 has the same delay as frame number 4. In this case, the phase offset (136)=2 and the run length (138)=2.

Figure 11:
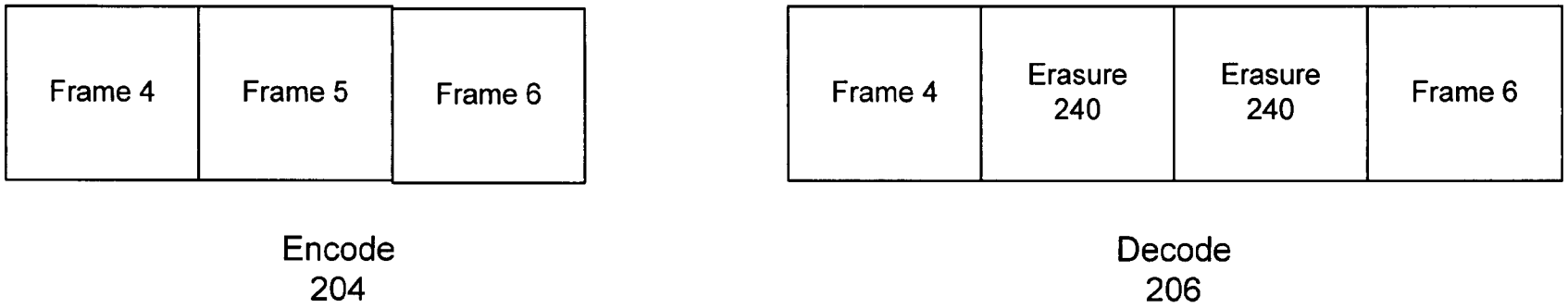
FIG. 11 illustrates an embodiment in which the decoder decodes two erasures after decoding frame 4 and is ready to decode frame 6.

In another embodiment shown in FIG. 11, the decoder 206 decodes two erasures 240 after decoding frame 4. After the erasures 240, it is ready to decode frame 6. Assume that the phases of the encoder 204 and decoder 206 were in sync at the end of frame 4 with phase equal to Phase_Start. The states of the encoder 204 and decoder 206 are shown in FIG. 11.

In this case, the encoder's 204 phase at the beginning of frame 6=Enc_Phase=Phase_Start+(160 mod Delay (5))/Delay (5).

The decoder's 206 phase at the beginning of frame 6=Dec_Phase=Phase_Start+((160 mod Delay (4))*2)/Delay (4), where it is assumed each erasure 240 has the same delay as frame number 4. Thus the total delay caused by the two erasures 240, one for missing frame 4 and one for missing frame 5, equals 2 times Delay (4). In this case, phase offset (136)=1 and the run length (138)=2.

Figure 12:
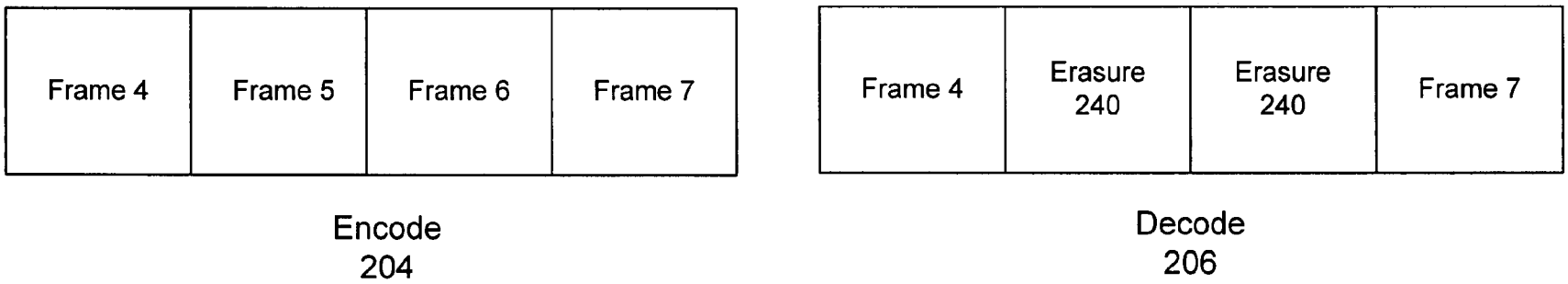
FIG. 12 illustrates and embodiment in which the decoder decodes two erasures after decoding frame 4 and is ready to decode frame 7.

In another embodiment shown in FIG. 12, the decoder 206 decodes two erasures 240 after decoding frame 4. After the erasures 240, it is ready to decode frame 7. Assume that the phases of the encoder 204 and decoder 206 were in sync at the end of frame 4 with phase equal to Phase_Start. The states of the encoder 204 and decoder 206 are shown in FIG. 12.

In this case, the encoder's 204 phase at the beginning of frame 6=Enc_Phase=Phase_Start+((160 mod Delay (5))/Delay (5)+(160 mod Delay (6))/Delay (6)).

The decoder's 204 phase at the beginning of frame 6=Dec_Phase=Phase_Start+((160 mod Delay (4))*2)/Delay (4). In this case, the phase offset (136)=0 and the run length (138)=2.

Concealing Double Erasures

Figure 13:
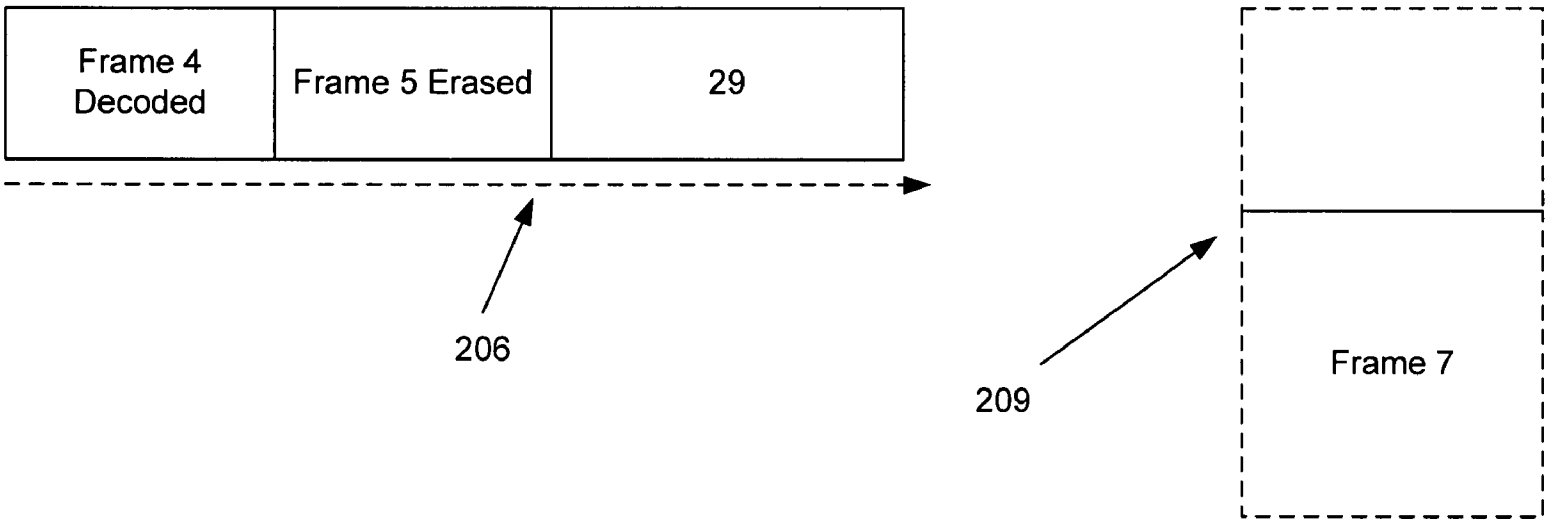
FIG. 13 illustrates warping frame 7 to fill an erasure of frame 6.

Double erasures 240 are known to cause more significant degradation in voice quality compared to single erasures 240. The same methods described earlier can be used to correct phase discontinuities caused by a double erasure 240. Consider FIG. 13, where voice frame 4 has been decoded and frame 5 has been erased. In FIG. 13, warping frame 7 is used to fill the erasure 240 of frame 6. That is, frame 7 is decoded and time-warped to fill the space of frame 6 which is shown as reference numeral 29 in FIG. 13.

At this time, frame 6 is not in the de-jitter buffer 209, but frame 7 is present. Thus, frame 7 can now be phase-matched with the end of the erased frame 5 and then expanded to fill the hole of frame 6. This effectively converts a double erasure 240 into a single erasure 240. Significant voice quality benefits may be attained by converting double erasure 240 to single erasures 240.

In the above example, the pitch periods 100 of frames 4 and 7 are carried by the frames 20 themselves, and the pitch period 100 of frame 6 is also carried by frame 7. The pitch period 100 of frame 5 is unknown. However, if the pitch periods 100 of frames 4, 6 and 7 are similar, there is a high likelihood that the pitch period 100 of frame 5 is also similar to the other pitch periods 100.

Figure 14:
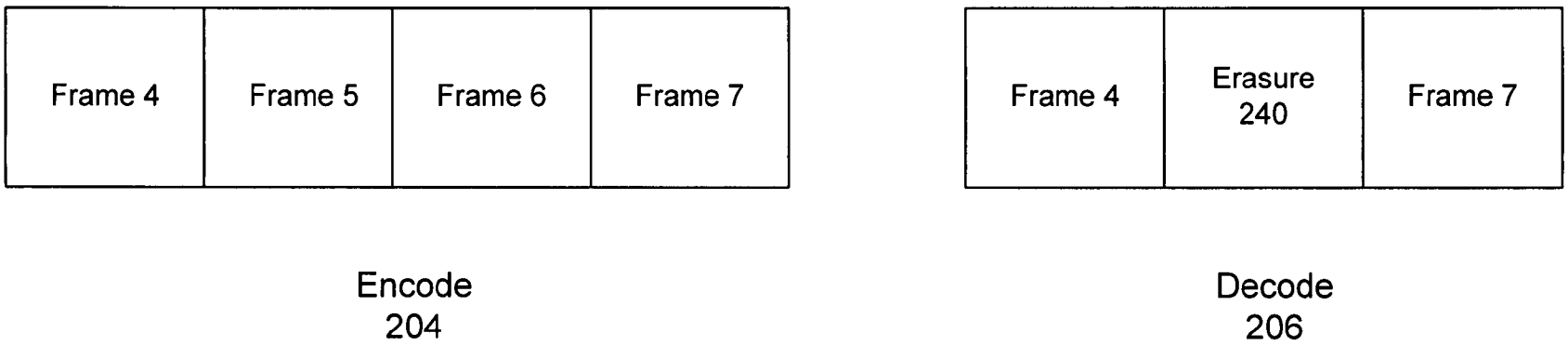
FIG. 14 illustrates converting a double erasure for missing packets 5 and 6 into a single erasure.

In another embodiment shown in FIG. 14 showing how double erasure are converted to single erasures, the decoder 206 plays one erasure 240 after decoding frame 4. After the erasure 240, it is ready to decode frame 7 (note that in addition to frame 5, frame 6 is also missing). Thus, a double erasure 240 for missing frames 5 and 6 will be converted into a single erasure 240. Assume that the phases of the encoder 204 and decoder 206 were in sync at the end of frame 4 with phase equal to Phase_Start. The states of the encoder 204 and decoder 206 are shown in FIG. 14. In this case, the encoder's 204 phase at the beginning of packet 7=Enc_Phase=Phase_Start+((160 mod Delay (5))/Delay (5)+(160 mod Delay (6))/Delay (6)).

The decoder's 206 phase at the beginning of packet 7=Dec_Phase=Phase_Start+(160 mod Delay (4))/Delay (4), where it is assumed that the erasure has a pitch delay equal to frame 4's pitch delay and a length=160 PCM samples.

In this case, the phase offset (136)=−1 and the run length (138)=1. The phase offset 136 equals−1 because one erasure 240 is used to replace two frames, frame 5 and frame 6.

The amount of phase matching that needs to be done is:

```
    If (Dec_Phase >= Enc_Phase)
    Phase_Matching = (Dec_Phase − Enc_Phase) *
    Delay_End (previous_frame)
Else
    Phase_Matching = Delay_End (previous_frame) −
((Enc_Phase − Dec_Phase) * Delay_End (previous_frame)).
```

In all of the disclosed embodiments, the phase matching and time warping instructions may be stored in software 216 or firmware located in decoder memory 207 located in the decoder 206 or outside the decoder 206. The memory 207 can be ROM memory, although any of a number of different types of memory may be used such as RAM, CD, DVD, magnetic core, etc.

Section II—Time Warping

Features of Using Time-Warping in a Vocoder

Human voices consist of two components. One component comprises fundamental waves that are pitch-sensitive and the other is fixed harmonics which are not pitch sensitive. The perceived pitch of a sound is the ear's response to frequency, i.e., for most practical purposes the pitch is the frequency. The harmonics components add distinctive characteristics to a person's voice. They change along with the vocal cords and with the physical shape of the vocal tract and are called formants.

Human voice can be represented by a digital signal s(n) 10. Assume s(n) 10 is a digital speech signal obtained during a typical conversation including different vocal sounds and periods of silence. The speech signal s(n) 10 is preferably portioned into frames 20. In one embodiment, s(n) 10 is digitally sampled at 8 kHz.

Current coding schemes compress a digitized speech signal 10 into a low bit rate signal by removing all of the natural redundancies (i.e., correlated elements) inherent in speech. Speech typically exhibits short term redundancies resulting from the mechanical action of the lips and tongue, and long term redundancies resulting from the vibration of the vocal cords. Linear Predictive Coding (LPC) filters the speech signal 10 by removing the redundancies producing a residual speech signal 30. It then models the resulting residual signal 30 as white Gaussian noise. A sampled value of a speech waveform may be predicted by weighting a sum of a number of past samples 40, each of which is multiplied by a linear predictive coefficient 50. Linear predictive coders, therefore, achieve a reduced bit rate by transmitting filter coefficients 50 and quantized noise rather than a full bandwidth speech signal 10. The residual signal 30 is encoded by extracting a prototype period 100 from a current frame 20 of the residual signal 30.

Figure 15:
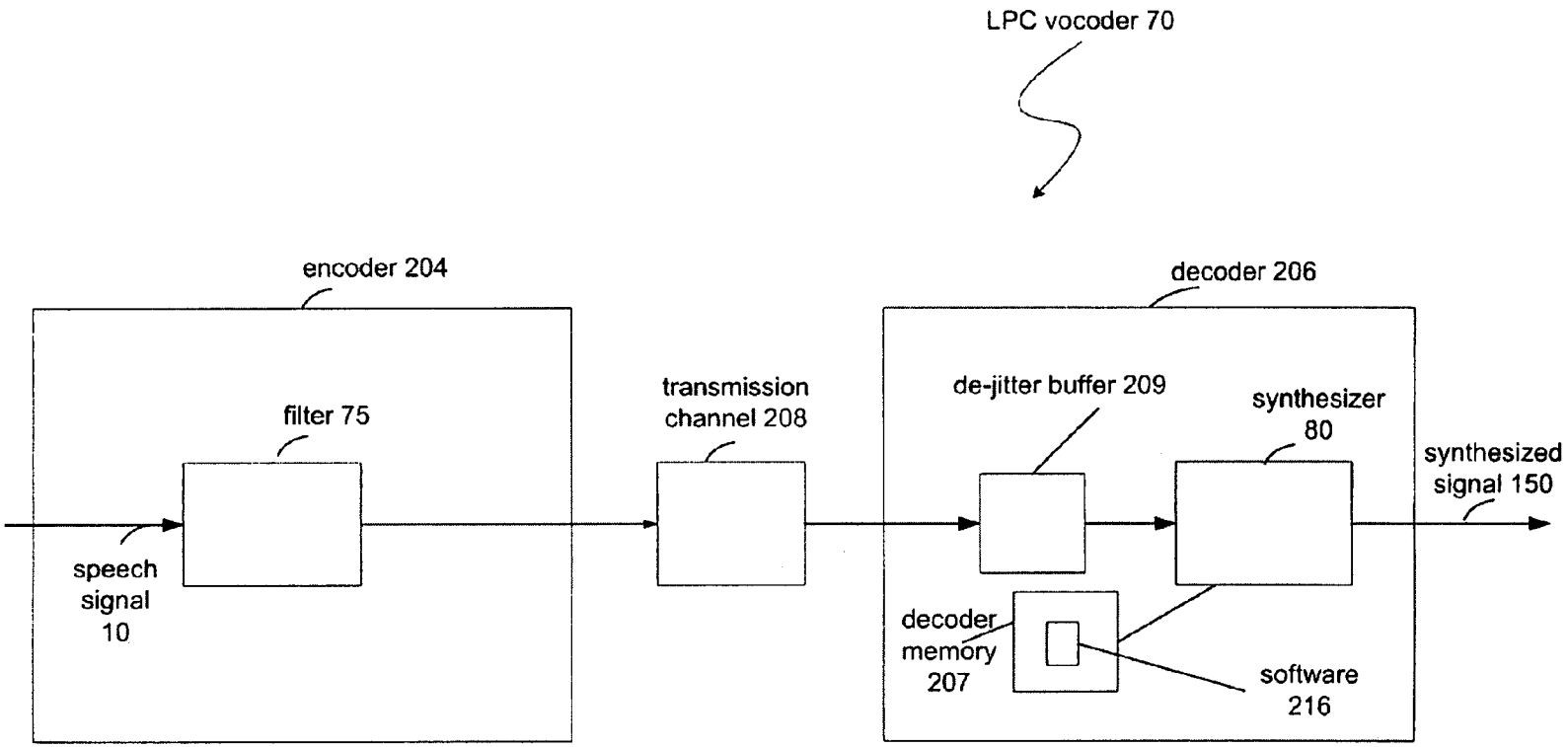
FIG. 15 is a block diagram of one embodiment of a Linear Predictive Coding (LPC) vocoder used by the present method and apparatus.

A block diagram of an LPC vocoder 70 can be seen in FIG. 15. The function of LPC is to minimize the sum of the squared differences between the original speech signal and the estimated speech signal over a finite duration. This may produce a unique set of predictor coefficients 50 which are normally estimated every frame 20. A frame 20 is typically 20 ms long. The transfer function of the time-varying digital filter 75 is given by:

$$H(z) = \frac{G}{1 - \sum a_k z^{-k}},$$

where the predictor coefficients 50 are represented by $a_k$ and the gain by G.

The summation is computed from k=1 to k=p. If an LPC-10 method is used, then p=10. This means that only the first 10 coefficients 50 are transmitted to the LPC synthesizer 80. The two most commonly used methods to compute the coefficients are, but not limited to, the covariance method and the auto-correlation method.

It is common for different speakers to speak at different speeds. Time compression is one method of reducing the effect of speed variation for individual speakers. Timing differences between two speech patterns may be reduced by warping the time axis of one so that the maximum coincidence is attained with the other. This time compression technique is known as time-warping. Furthermore, time-warping compresses or expands voice signals without changing their pitch.

Typical vocoders produce frames 20 of 20 msec duration, including 160 samples 90 at the preferred 8 kHz rate. A time-warped compressed version of this frame 20 has a duration smaller than 20 msec, while a time-warped expanded version has a duration larger than 20 msec. Time-warping of voice data has significant advantages when sending voice data over packet-switched networks, which introduce delay jitter in the transmission of voice packets. In such networks, time-warping can be used to mitigate the effects of such delay jitter and produce a "synchronous" looking voice stream.

Embodiments of the invention relate to an apparatus and method for time-warping frames 20 inside the vocoder 70 by manipulating the speech residual 30. In one embodiment, the present method and apparatus is used in 4GV. The disclosed embodiments comprise methods and apparatuses or systems to expand/compress different types of 4GV speech segments 110 encoded using Prototype Pitch Period (PPP), Code-Excited Linear Prediction (CELP) or Noise-Excited Linear Prediction (NELP) coding.

The term "vocoder" 70 typically refers to devices that compress voiced speech by extracting parameters based on a model of human speech generation. Vocoders 70 include an encoder 204 and a decoder 206. The encoder 204 analyzes the incoming speech and extracts the relevant parameters. In one embodiment, the encoder comprises a filter 75. The decoder 206 synthesizes the speech using the parameters that it receives from the encoder 204 via a transmission channel 208. In one embodiment, the decoder comprises a synthesizer 80. The speech signal 10 is often divided into frames 20 of data and block processed by the vocoder 70.

Figure 16A:
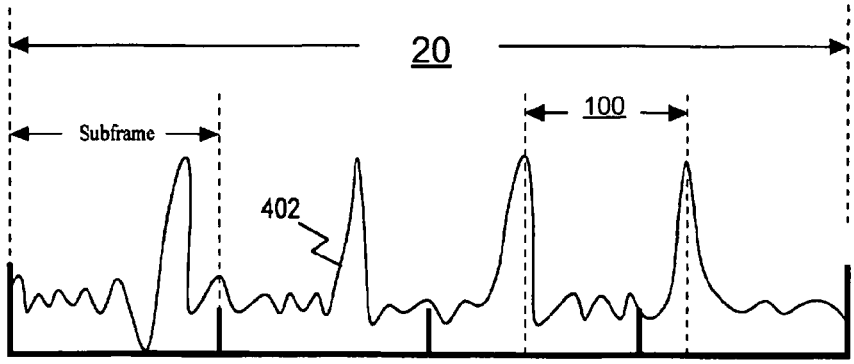
FIG. 16A is a speech signal containing voiced speech.

Those skilled in the art will recognize that human speech can be classified in many different ways. Three conventional classifications of speech are voiced, unvoiced sounds and transient speech. FIG. 16*a* is a voiced speech signal s(n) 402. FIG. 16A shows a measurable, common property of voiced speech known as the pitch period 100.

Figure 16B:
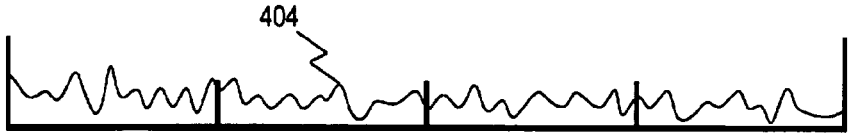
FIG. 16B is a speech signal containing unvoiced speech.

FIG. 16B is an unvoiced speech signal s(n) 404. An unvoiced speech signal 404 resembles colored noise.

Figure 16C:
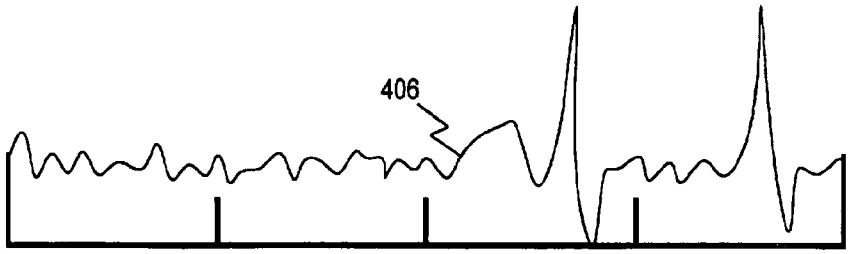
FIG. 16C is a speech signal containing transient speech.

FIG. 16C depicts a transient speech signal s(n) 406 (i.e., speech which is neither voiced nor unvoiced). The example of transient speech 406 shown in FIG. 16C might represent s(n) transitioning between unvoiced speech and voiced speech. These three classifications are not all inclusive. There are many different classifications of speech which may be employed according to the methods described herein to achieve comparable results.

The 4GV Vocoder Uses 4 Different Frame Types

The fourth generation vocoder (4GV) 70 used in one embodiment of the invention provides attractive features for use over wireless networks. Some of these features include the ability to trade-off quality vs. bit rate, more resilient vocoding in the face of increased Packet Error Rate (PER), better concealment of erasures, etc. The 4GV vocoder 70 can use any of four different encoders 204 and decoders 206. The different encoders 204 and decoders 206 operate according to different coding schemes. Some encoders 204 are more effective at coding portions of the speech signal s(n) 10 exhibiting certain properties. Therefore, in one embodiment, the encoders 204 and decoders 206 mode may be selected based on the classification of the current frame 20.

The 4GV encoder 204 encodes each frame 20 of voice data into one of four different frame 20 types: Prototype Pitch Period Waveform Interpolation (PPPWI), Code-Excited Linear Prediction (CELP), Noise-Excited Linear Prediction (NELP), or silence $1/8^{th}$ rate frame. CELP is used to encode speech with poor periodicity or speech that involves changing from one periodic segment 110 to another. Thus, the CELP mode is typically chosen to code frames classified as transient speech. Since such segments 110 cannot be accurately reconstructed from only one prototype pitch period, CELP encodes characteristics of the complete speech segment 110. The CELP mode excites a linear predictive vocal tract model with a quantized version of the linear prediction residual signal 30. Of all the encoders 204 and decoders 206 described herein, CELP generally produces more accurate speech reproduction, but requires a higher bit rate.

A Prototype Pitch Period (PPP) mode can be chosen to code frames 20 classified as voiced speech. Voiced speech contains slowly time varying periodic components which are exploited by the PPP mode. The PPP mode codes a subset of the pitch periods 100 within each frame 20. The remaining periods 100 of the speech signal 10 are reconstructed by interpolating between these prototype periods 100. By exploiting the periodicity of voiced speech, PPP is able to achieve a lower bit rate than CELP and still reproduce the speech signal 10 in a perceptually accurate manner.

PPPWI is used to encode speech data that is periodic in nature. Such speech is characterized by different pitch periods 100 being similar to a "prototype" pitch period (PPP). This PPP is the only voice information that the encoder 204 needs to encode. The decoder can use this PPP to reconstruct other pitch periods 100 in the speech segment 110.

A "Noise-Excited Linear Predictive" (NELP) encoder 204 is chosen to code frames 20 classified as unvoiced speech. NELP coding operates effectively, in terms of signal reproduction, where the speech signal 10 has little or no pitch structure. More specifically, NELP is used to encode speech that is noise-like in character, such as unvoiced speech or background noise. NELP uses a filtered pseudo-random noise signal to model unvoiced speech. The noise-like character of such speech segments 110 can be reconstructed by generating random signals at the decoder 206 and applying appropriate gains to them. NELP uses the simplest model for the coded speech, and therefore achieves a lower bit rate.

$1/8^{th}$ rate frames are used to encode silence, e.g., periods where the user is not talking.

Figure 17:
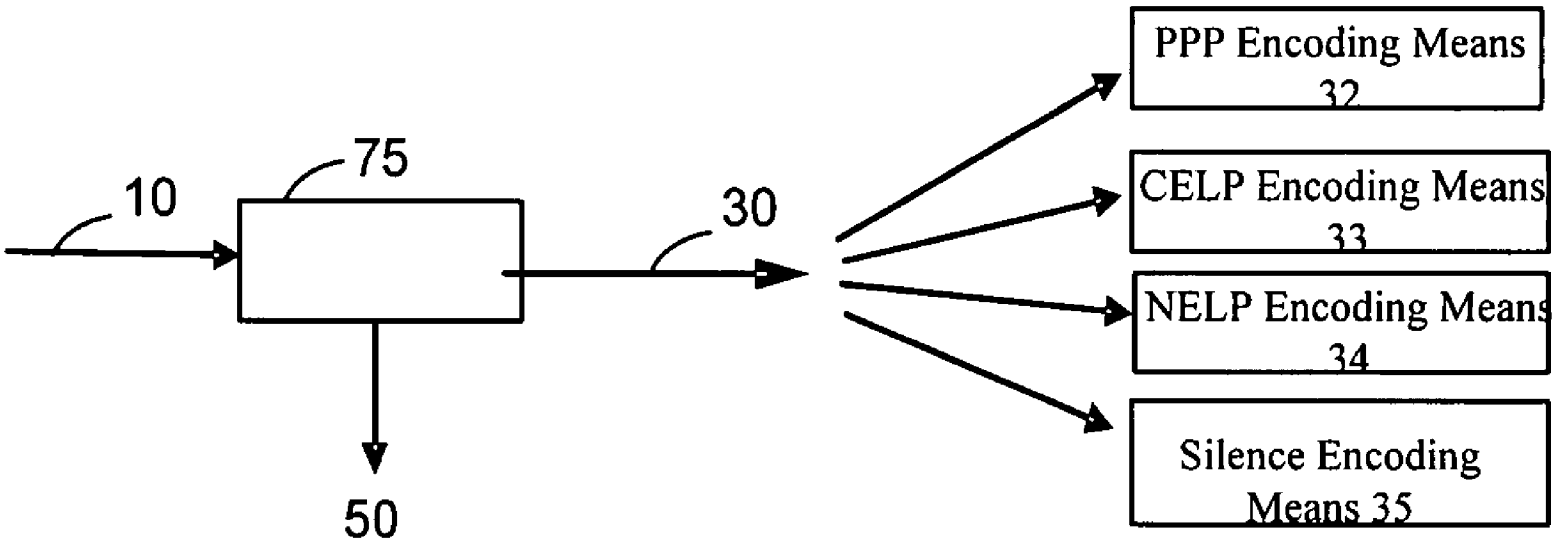
FIG. 17 is a block diagram illustrating LPC Filtering of Speech followed by Encoding of a Residual.

All of the four vocoding schemes described above share the initial LPC filtering procedure as shown in FIG. 17. After characterizing the speech into one of the 4 categories, the speech signal 10 is sent through a linear predictive coding (LPC) filter 80 which filters out short-term correlations in the speech using linear prediction. The outputs of this block are the LPC coefficients 50 and the "residual" signal 30, which is basically the original speech signal 10 with the short-term correlations removed from it. The residual signal 30 is then encoded using the specific methods used by the vocoding method selected for the frame 20.

Figures 18A, 18B:
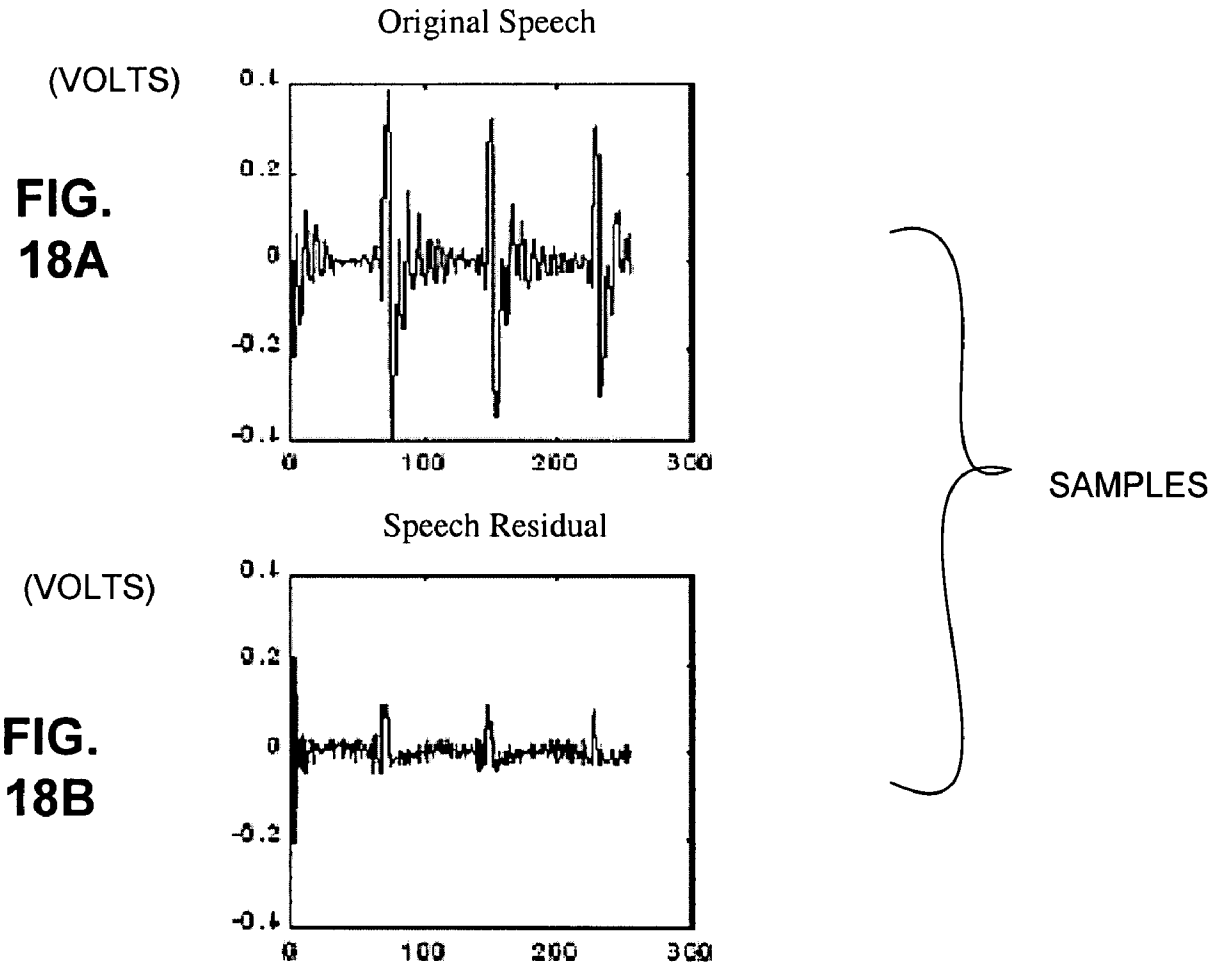
FIG. 18A is a plot of Original Speech.
FIG. 18B is a plot of a Residual Speech Signal after LPC Filtering.

FIG. 18 shows an example of the original speech signal 10 and the residual signal 30 after the LPC block 80. It can be seen that the residual signal 30 shows pitch periods 100 more distinctly than the original speech 10. It stands to reason, thus, that the residual signal 30 can be used to determine the pitch period 100 of the speech signal more accurately than the original speech signal 10 (which also contains short-term correlations).

Residual Time Warping

As stated above, time-warping can be used for expansion or compression of the speech signal 10. While a number of methods may be used to achieve this, most of these are based on adding or deleting pitch periods 100 from the signal 10. The addition or subtraction of pitch periods 100 can be done in the decoder 206 after receiving the residual signal 30, but before the signal 30 is synthesized. For speech data that is encoded using either CELP or PPP (not NELP), the signal includes a number of pitch periods 100. Thus, the smallest unit that can be added or deleted from the speech signal 10 is a pitch period 100 since any unit smaller than this will lead to a phase discontinuity resulting in the introduction of a noticeable speech artifact. Thus, one step in time-warping methods applied to CELP or PPP speech is estimation of the pitch period 100. This pitch period 100 is already known to the decoder 206 for CELP/PPP speech frames 20. In the case of both PPP and CELP, pitch information is calculated by the encoder 204 using auto-correlation methods and is transmitted to the decoder 206. Thus, the decoder 206 has accurate knowledge of the pitch period 100. This makes it simpler to apply the time-warping method of the present invention in the decoder 206.

Furthermore, as stated above, it is simpler to time warp the signal 10 before synthesizing the signal 10. If such time-warping methods were to be applied after decoding the signal 10, the pitch period 100 of the signal 10 would need to be estimated. This requires not only additional computation, but also the estimation of the pitch period 100 may not be very accurate since the residual signal 30 also contains LPC information 170.

On the other hand, if the additional pitch period 100 estimation is not too complex, then doing time-warping after decoding does not require changes to the decoder 206 and can thus be implemented just once for all vocoders 80.

Another reason for doing time-warping in the decoder 206 before synthesizing the signal using LPC coding synthesis is that the compression/expansion can be applied to the residual signal 30. This allows the Linear Predictive Coding (LPC) synthesis to be applied to the time-warped residual signal 30. The LPC coefficients 50 play a role in how speech sounds and applying synthesis after warping ensures that correct LPC information 170 is maintained in the signal 10.

If, on the other hand, time-warping is done after the decoding the residual signal 30, the LPC synthesis has already been performed before time-warping. Thus, the warping procedure can change the LPC information 170 of the signal 10, especially if the pitch period 100 prediction post-decoding has not been very accurate.

The encoder 204 (such as the one in 4GV) may categorize speech frames 20 as PPP (periodic), CELP (slightly periodic) or NELP (noisy) depending on whether the frames 20 represents voiced, unvoiced or transient speech. Using information about the speech frame 20 type, the decoder 206 can time-warp different frame 20 types using different methods. For instance, a NELP speech frame 20 has no notion of pitch periods and its residual signal 30 is generated at the decoder 206 using "random" information. Thus, the pitch period 100 estimation of CELP/PPP does not apply to NELP and, in general, NELP frames 20 may be warped (expanded/compressed) by less than a pitch period 100. Such information is not available if time-warping is performed after decoding the residual signal 30 in the decoder 206. In general, time-warping of NELP-like frames 20 after decoding leads to speech artifacts. Warping of NELP frames 20 in the decoder 206, on the other hand, produces much better quality.

Thus, there are two advantages to doing time-warping in the decoder 206 (i.e., before the synthesis of the residual signal 30) as opposed to post-decoder (i.e., after the residual signal 30 is synthesized): (i) reduction of computational overhead (e.g., a search for the pitch period 100 is avoided), and (ii) improved warping quality due to a) knowledge of the frame 20 type, b) performing LPC synthesis on the warped signal and c) more accurate estimation/knowledge of pitch period.

Residual Time Warping Methods

The following describe embodiments in which the present method and apparatus time-warps the speech residual 30 inside PPP, CELP and NELP decoders. The following two steps are performed in each decoder 206: (i) time-warping the residual signal 30 to an expanded or compressed version; and (ii) sending the time-warped residual 30 through an LPC filter 80. Furthermore, step (i) is performed differently for PPP, CELP and NELP speech segments 110. The embodiments will be described below.

Time-Warping of Residual Signal when the Speech Segment 110 is PPP

Figure 19:
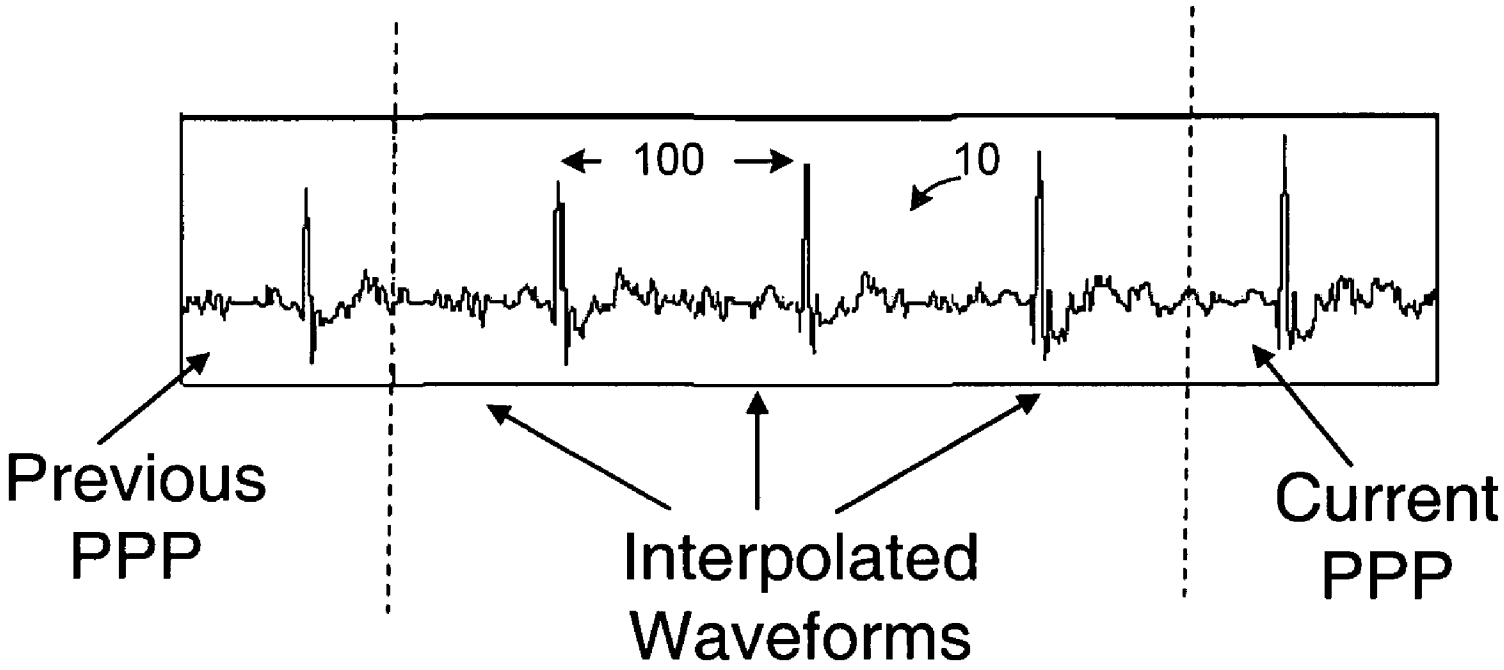
FIG. 19 illustrates the generation of Waveforms using Interpolation between Previous and Current Prototype Pitch Periods.

As stated above, when the speech segment 110 is PPP, the smallest unit that can be added or deleted from the signal is a pitch period 100. Before the signal 10 can be decoded (and the residual 30 reconstructed) from the prototype pitch period 100, the decoder 206 interpolates the signal 10 from the previous prototype pitch period 100 (which is stored) to the prototype pitch period 100 in the current frame 20, adding the missing pitch periods 100 in the process. This process is depicted in FIG. 19. Such interpolation lends itself rather easily to time-warping by producing less or more interpolated pitch periods 100. This will lead to compressed or expanded residual signals 30 which are then sent through the LPC synthesis.

Time-Warping of Residual Signal when Speech Segment 110 is CELP

As stated earlier, when the speech segment 110 is PPP, the smallest unit that can be added or deleted from the signal is a pitch period 100. On the other hand, in the case of CELP, warping is not as straightforward as for PPP. In order to warp the residual 30, the decoder 206 uses pitch delay 180 information contained in the encoded frame 20. This pitch delay 180 is actually the pitch delay 180 at the end of the frame 20. It should be noted here that even in a periodic frame 20, the pitch delay 180 may be slightly changing. The pitch delays 180 at any point in the frame can be estimated by interpolating between the pitch delay 180 at the end of the last frame 20 and that at the end of the current frame 20. This is shown in FIG. 20. Once pitch delays 180 at all points in the frame 20 are known, the frame 20 can be divided into pitch periods 100. The boundaries of pitch periods 100 are determined using the pitch delays 180 at various points in the frame 20.

Figure 20A:
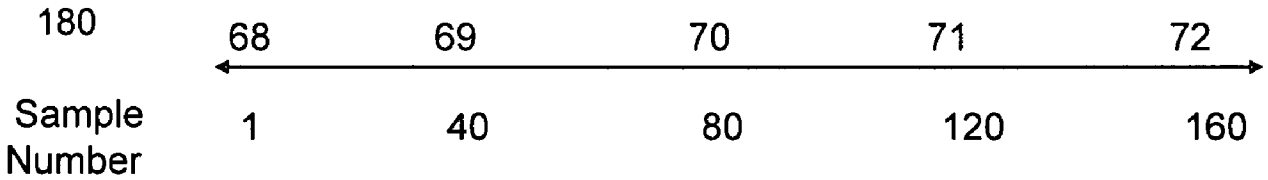
FIG. 20A depicts determining Pitch Delays through Interpolation.
Figure 20B:
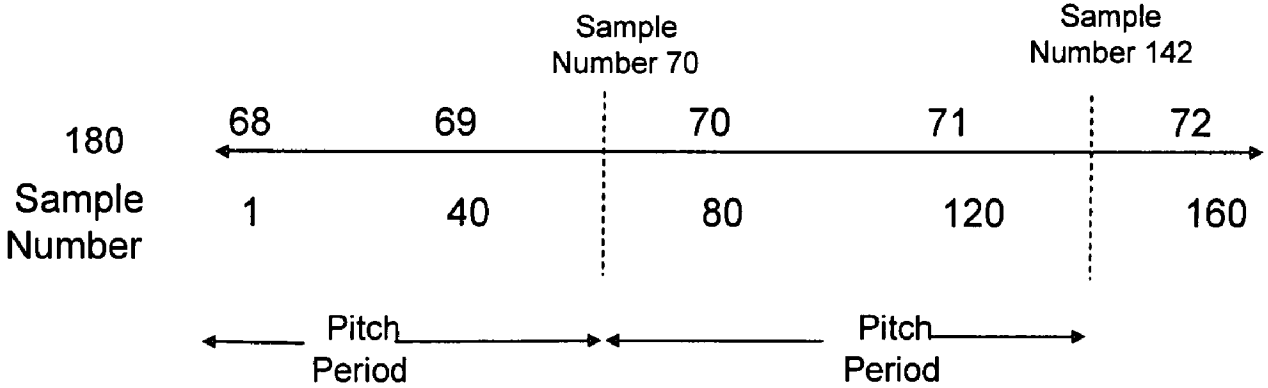
FIG. 20B depicts identifying pitch periods.

FIG. 20A shows an example of how to divide the frame 20 into its pitch periods 100. For instance, sample number 70 has a pitch delay 180 equal to approximately 70 and sample number 142 has a pitch delay 180 of approximately 72. Thus, the pitch periods 100 are from sample numbers [1-70] and from sample numbers [71-142]. See FIG. 20B.

Once the frame 20 has been divided into pitch periods 100, these pitch periods 100 can then be overlap-added to increase/decrease the size of the residual 30. See FIGS. 21B through 21F. In overlap and add synthesis, the modified signal is obtained by excising segments 110 from the input signal 10, repositioning them along the time axis and performing a weighted overlap addition to construct the synthesized signal 150. In one embodiment, the segment 110 can equal a pitch period 100. The overlap-add method replaces two different speech segments 110 with one speech segment 110 by "merging" the segments 110 of speech. Merging of speech is done in a manner preserving as much speech quality as possible. Preserving speech quality and minimizing introduction of artifacts into the speech is accomplished by carefully selecting the segments 110 to merge. (Artifacts are unwanted items like clicks, pops, etc.). The selection of the speech segments 110 is based on segment "similarity." The closer the "similarity" of the speech segments 110, the better the resulting speech quality and the lower the probability of introducing a speech artifact when two segments 110 of speech are overlapped to reduce/increase the size of the speech residual 30. A useful rule to determine if pitch periods should be overlap-added is if the pitch delays of the two are similar (as an example, if the pitch delays differ by less than 15 samples, which corresponds to about 1.8 msec).

Figure 21A:
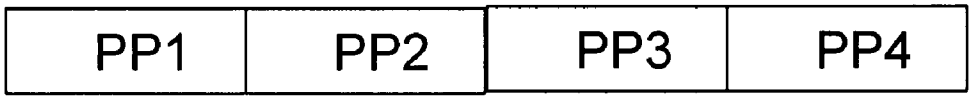
FIG. 21A represents an original speech signal in the form of pitch periods.
Figure 21B:
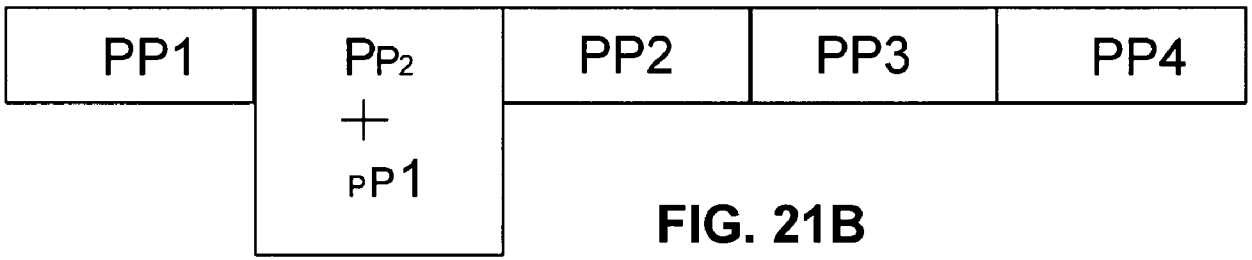
FIG. 21B represents a speech signal expanded using overlap-add.
Figure 21C:
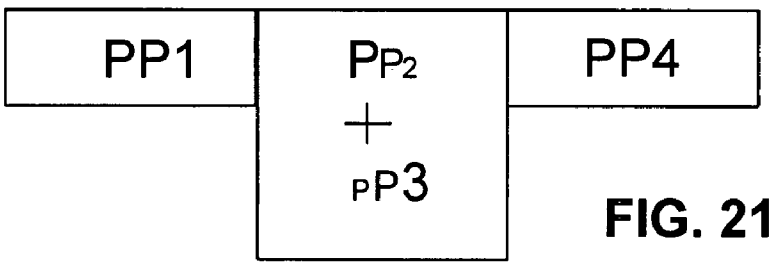
FIG. 21C represents a speech signal compressed using overlap-add.

FIG. 21C shows how overlap-add is used to compress the residual 30. The first step of the overlap/add method is to segment the input sample sequence s[n] 10 into its pitch periods as explained above. In FIG. 21A, the original speech signal 10 including 4 pitch periods 100 (PPs) is shown. The next step includes removing pitch periods 100 of the signal 10 as shown in FIG. 7 and replacing these pitch periods 100 with a merged pitch period 100. For example in FIG. 21C, pitch periods PP2 and PP3 are removed and then replaced with one pitch period 100 in which PP2 and PP3 are overlap-added. More specifically, in FIG. 21C, pitch periods 100 PP2 and PP3 are overlap-added such that the second pitch period's 100 (PP2) contribution goes on decreasing and that of PP3 is increasing. The add-overlap method produces one speech segment 110 from two different speech segments 110. In one embodiment, the add-overlap is performed using weighted samples. This is illustrated in equations a) and b) shown in FIG. 22. Weighting is used to provide a smooth transition between the first PCM (Pulse Coded Modulation) sample of Segment1 (110) and the last PCM sample of Segment2 (110).

Figure 21D:
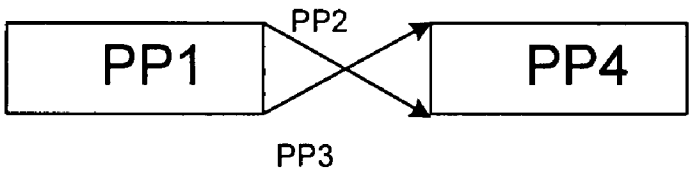
FIG. 21D represents how weighting is used to compress the residual signal.
Figure 21E:
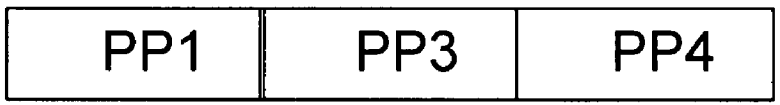
FIG. 21E represents a speech signal compressed without using overlap-add.

FIG. 21D is another graphic illustration of PP2 and PP3 being overlap-added. The cross fade improves the perceived quality of a signal 10 time compressed by this method when compared to simply removing one segment 110 and abutting the remaining adjacent segments 110 (as shown in FIG. 21E).

In cases when the pitch period 100 is changing, the overlap-add method may merge two pitch periods 110 of unequal length. In this case, better merging may be achieved by aligning the peaks of the two pitch periods 100 before overlap-adding them. The expanded/compressed residual is then sent through the LPC synthesis.

Speech Expansion

A simple approach to expanding speech is to do multiple repetitions of the same PCM samples. However, repeating the same PCM samples more than once can create areas with pitch flatness which is an artifact easily detected by humans (e.g., speech may sound a bit "robotic"). In order to preserve speech quality, the add-overlap method may be used.

Figure 21F:
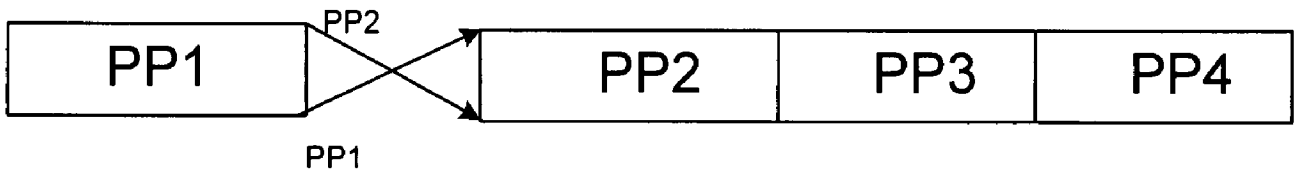
FIG. 21F represents how weighting is used to expand the residual signal.

FIG. 21B shows how this speech signal 10 can be expanded using the overlap-add method of the present invention. In FIG. 21B, an additional pitch period 100 created from pitch periods 100 PP1 and PP2 is added. In the additional pitch period 100, pitch periods 100 PP2 and PP1 are overlap-added such that the second pitch (PP2) period's 100 contribution goes on decreasing and that of PP1 is increasing. FIG. 21F is another graphic illustration of PP2 and PP3 being overlap added.

Time-Warping of the Residual Signal when the Speech Segment is NELP:

For NELP speech segments, the encoder encodes the LPC information as well as the gains for different parts of the speech segment 110. It is not necessary to encode any other information since the speech is very noise-like in nature. In one embodiment, the gains are encoded in sets of 16 PCM samples. Thus, for example, a frame of 160 samples may be represented by 10 encoded gain values, one for each 16 samples of speech. The decoder 206 generates the residual signal 30 by generating random values and then applying the respective gains on them. In this case, there may not be a concept of pitch period 100, and as such, the expansion/compression does not have to be of the granularity of a pitch period 100.

In order to expand or compress a NELP segment, the decoder 206 generates a larger or smaller number of segments (110) than 160, depending on whether the segment 110 is being expanded or compressed. The 10 decoded gains are then applied to the samples to generate an expanded or compressed residual 30. Since these 10 decoded gains correspond to the original 160 samples, these are not applied directly to the expanded/compressed samples. Various methods may be used to apply these gains. Some of these methods are described below.

If the number of samples to be generated is less than 160, then all 10 gains need not be applied. For instance, if the number of samples is 144, the first 9 gains may be applied. In this instance, the first gain is applied to the first 16 samples, samples 1-16, the second gain is applied to the next 16 samples, samples 17-32, etc. Similarly, if samples are more than 160, then the $10^{th}$ gain can be applied more than once. For instance, if the number of samples is 192, the $10^{th}$ gain can be applied to samples 145-160, 161-176, and 177-192.

Alternately, the samples can be divided into 10 sets of equal number, each set having an equal number of samples, and the 10 gains can be applied to the 10 sets. For instance, if the number of samples is 140, the 10 gains can be applied to sets of 14 samples each. In this instance, the first gain is applied to the first 14 samples, samples 1-14, the second gain is applied to the next 14 samples, samples 15-28, etc.

If the number of samples is not perfectly divisible by 10, then the $10^{th}$ gain can be applied to the remainder samples obtained after dividing by 10. For instance, if the number of samples is 145, the 10 gains can be applied to sets of 14 samples each. Additionally, the $10^{th}$ gain is applied to samples 141-145.

After time-warping, the expanded/compressed residual 30 is sent through the LPC synthesis when using any of the above recited encoding methods.

Figure 23:
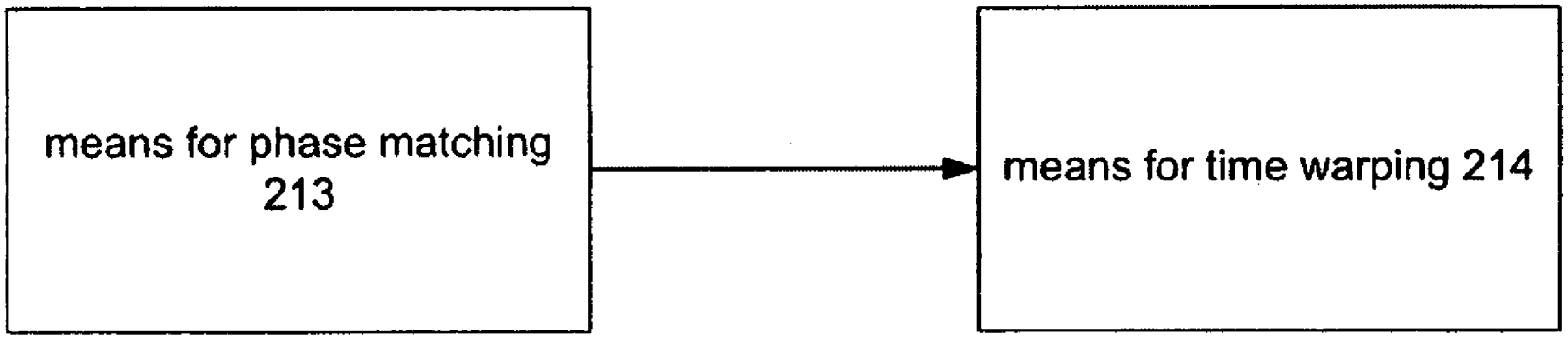
FIG. 23 is a logic block diagram of a means for phase matching 213 and a means for time warping 214.

The present method and application can also be illustrated using means plus function blocks as shown in FIG. 23 which discloses a means for phase matching 213 and a means for time warping 214.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The various illustrative logical blocks, modules, and circuits described in connection with the embodiments disclosed herein may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A method of minimizing artifacts in speech, said method comprising performing each of the following acts within a device that is configured to process audio signals:

detecting that an expected frame of a signal being decoded is absent from a buffer;

based on a phase of the decoded signal at the expected frame, obtaining a phase for matching; and decoding a received frame that is subsequent in the signal to the expected frame, wherein said decoding the received frame comprises one among (A) increasing the number of samples in the frame as decoded, based on the phase for matching, and (B) decreasing the number of samples in the frame as decoded, based on the phase for matching;

wherein said one among increasing and decreasing the number of samples of said frame as decoded comprises decoding said frame at an offset from a beginning of said frame, such that a first sample of the decoded frame is phase-matched to the phase for matching, and wherein the phase for matching is based on a phase at the end of a decoded frame that is prior to the expected frame.

2. The method of minimizing artifacts in speech according to claim 1, wherein said received frame encodes a frame having a length of n samples, and wherein said decoding said frame at an offset comprises discarding at least one sample of the frame as decoded to produce a frame of the decoded signal that corresponds to the received frame and has a length of less than n samples.

3. The method of minimizing artifacts in speech according to claim 2, said method comprising inserting an erasure in the decoded signal at the expected frame, wherein said decoding a received frame comprises discarding samples of said frame such that a phase at an end of said frame as decoded matches with said phase for matching, and wherein the phase for matching is based on a phase at an end of said erasure.

4. The method of minimizing artifacts in speech according to claim 3, wherein said decoding a received frame comprises time-warping said frame.

5. The method of minimizing artifacts in speech according to claim 4, wherein said time-warping said frame comprises interpolating from one pitch period to another to obtain interpolated pitch periods of an expanded residual signal of said frame.

6. The method of minimizing artifacts in speech according to claim 2, wherein said decoding a received frame comprises time-warping said frame.

7. The method of minimizing artifacts in speech according to claim 1, wherein said decoding said frame at an offset comprises:

finding a number of samples in said frame after which a phase is similar to said phase for matching; and shifting fixed codebook impulses of said frame by said number of samples.

8. The method of minimizing artifacts in speech according to claim 7, wherein said decoding a received frame comprises time-warping said frame.

9. The method of minimizing artifacts in speech according to claim 8, wherein said time-warping said frame comprises adding at least one pitch period to a residual signal of said frame.

10. The method of minimizing artifacts in speech according to claim 8, wherein said time-warping said frame comprises:

at each of a plurality of points of the frame, estimating a pitch delay;

based on said plurality of estimated pitch delays, dividing the frame into a plurality of pitch periods; and adding a segment based on at least one of said plurality of pitch periods to said frame.

11. The method of minimizing artifacts in speech according to claim 1, wherein said decoding a received frame comprises time-warping said frame.

12. The method of minimizing artifacts in speech according to claim 1, wherein said decoding a received frame comprises calculating a difference between an encoder phase and a decoder phase.

13. The method of minimizing artifacts in speech according to claim 12, wherein said decoding a received frame comprises time-warping said frame.

14. The method of minimizing artifacts in speech according to claim 13, wherein said time-warping said frame comprises:

at each of a plurality of points of the frame, estimating a pitch delay;

based on said plurality of estimated pitch delays, dividing the frame into a plurality of pitch periods; and adding a segment based on at least one of said plurality of pitch periods to said frame.

15. The method of minimizing artifacts in speech according to claim 13, wherein said time-warping said frame comprises interpolating from one pitch period to another to obtain interpolated pitch periods of an expanded residual signal of said frame.

16. The method according to claim 12, wherein said decoding a received frame comprises multiplying said calculated difference by a pitch delay.

17. The method of minimizing artifacts in speech according to claim 1, wherein said decoding a received frame comprises time-warping said frame.

18. A processor-readable storage medium storing processor-readable instructions which when executed cause the processor to perform the method as recited in claim 1.

19. A decoder configured to decode an encoded speech signal, said decoder comprising:

a buffer configured to store frames of the signal being decoded;

a memory configured to store instructions; and a processor adapted to execute the stored instructions to perform a method of minimizing artifacts in speech, said method comprising:

detecting that an expected frame of the signal is absent from the buffer; based on a phase of the decoded signal at the expected frame, obtaining a phase for matching; and decoding a received frame that is subsequent in the signal to the expected frame, wherein said decoding the received frame comprises one among (A) increasing the number of samples in the frame as decoded, based on the phase for matching, and (B) decreasing the number of samples in the frame as decoded, based on the phase for matching;

wherein said one among increasing and decreasing the number of samples of said frame as decoded comprises decoding said frame at an offset from a beginning of said frame, such that a first sample of the decoded frame is phase-matched to the phase for matching, and wherein the phase for matching is based on a phase at the end of a decoded frame that is prior to the expected frame.

20. The decoder according to claim 19, wherein said received frame encodes a frame having a length of n samples, and wherein said decoding said frame at an offset comprises discarding at least one sample of the frame as decoded to produce a frame of the decoded signal that corresponds to the received frame and has a length of less than n samples.

21. The decoder according to claim 20, wherein said decoding a received frame comprises time-warping said frame.

22. The decoder according to claim 19, wherein said decoding said frame at an offset comprises:

finding a number of samples in said frame after which a phase is similar to said phase for matching; and shifting fixed codebook impulses of said frame by said number of samples.

23. The decoder according to claim 22, wherein said decoding a received frame comprises time-warping said frame.

24. The decoder according to claim 23, wherein said time-warping said frame comprises adding at least one pitch period to a residual signal of said frame.

25. The decoder according to claim 23, wherein said time-warping said frame comprises:

at each of a plurality of points of the frame, estimating a pitch delay;

based on said plurality of estimated pitch delays, dividing the frame into a plurality of pitch periods; and adding a segment based on at least one of said plurality of pitch periods to said frame.

26. The decoder according to claim 19, wherein said decoding a received frame comprises time-warping said frame.

27. The decoder according to claim 19, wherein said decoding a received frame comprises calculating a difference between an encoder phase and a decoder phase.

28. The decoder according to claim 27, wherein said decoding a received frame comprises time-warping said frame.

29. The decoder according to claim 28, wherein said time-warping said frame comprises:

at each of a plurality of points of the frame, estimating a pitch delay;

based on said plurality of estimated pitch delays, dividing the frame into a plurality of pitch periods; and adding a segment based on at least one of said plurality of pitch periods to said frame.

30. The decoder according to claim 28, wherein said time-warping said frame comprises interpolating from one pitch period to another to obtain interpolated pitch periods of an expanded residual signal of said frame.

31. The decoder according to claim 19, said method comprising inserting an erasure in the decoded signal at the expected frame, wherein said decoding a received frame comprises discarding samples of said frame such that a phase at an end of said frame as decoded matches with said phase for matching, and wherein the phase for matching is based on a phase at an end of said erasure.

32. The decoder according to claim 31, wherein said decoding a received frame comprises time-warping said frame.

33. The decoder according to claim 32, wherein said time-warping said frame comprises interpolating from one pitch period to another to obtain interpolated pitch periods of an expanded residual signal of said frame.

34. The decoder according to claim 19, wherein said decoding a received frame comprises time-warping said frame.

35. An apparatus, within a device that is configured to process audio signals, for minimizing artifacts in speech, comprising:

means for detecting that an expected frame of a signal being decoded is absent from a buffer;

means for obtaining a phase for matching, based on a phase of the decoded signal at the expected frame; and means for decoding a received frame that is subsequent in the signal to the expected frame, wherein said decoding the received frame comprises one among (A) increasing the number of samples in the frame as decoded, based on the phase for matching, and (B) decreasing the number of samples in the frame as decoded, based on the phase for matching;

wherein said means for decoding a received frame comprises means for decreasing the number of samples in the frame as decoded by decoding said frame at an offset from a beginning of said frame, such that a first sample of the decoded frame is phase-matched to the phase for matching, and wherein the phase for matching is based on a phase at the end of a decoded frame that is prior to the expected frame.

36. The apparatus for minimizing artifacts in speech according to claim 35, wherein said received frame encodes a frame having a length of n samples, and wherein said means for decoding a received frame is configured to perform said decoding said frame at an offset by discarding at least one sample of the frame as decoded to produce a frame of the decoded signal that corresponds to the received frame and has a length of less than n samples.

37. The apparatus for minimizing artifacts in speech according to claim 36, wherein said means for decoding a received frame includes means for time-warping said frame.

38. The apparatus for minimizing artifacts in speech according to claim 35, wherein said means for decoding a received frame comprises:

means for finding a number of samples in said frame after which a phase is similar to said phase for matching; and means for shifting fixed codebook impulses of said frame by said number of samples.

39. The apparatus for minimizing artifacts in speech according to claim 38, wherein said means for decoding a received frame includes means for time-warping said frame.

40. The apparatus for minimizing artifacts in speech according to claim 39, wherein said means for time-warping said frame comprises means for adding at least one pitch period to a residual signal of said frame.

41. The apparatus for minimizing artifacts in speech according to claim 39, wherein said means for time-warping said frame comprises:

means for estimating a pitch delay at each of a plurality of points of the frame;

means for dividing the frame into a plurality of pitch periods, based on said plurality of estimated pitch delays; and means for adding a segment based on at least one of said plurality of pitch periods to said frame.

42. The apparatus for minimizing artifacts in speech according to claim 35, wherein said means for decoding a received frame includes means for time-warping said frame.

43. The apparatus for minimizing artifacts in speech according to claim 35, wherein said means for decoding a received frame comprises means for calculating a difference between an encoder phase and a decoder phase.

44. The apparatus for minimizing artifacts in speech according to claim 43, wherein said means for decoding a received frame includes means for time-warping said frame.

45. The apparatus for minimizing artifacts in speech according to claim 44, wherein said means for time-warping said frame comprises:

means for estimating a pitch delay at each of a plurality of points of the frame;

means for dividing the frame into a plurality of pitch periods, based on said plurality of estimated pitch delays; and means for adding a segment based on at least one of said plurality of pitch periods to said frame.

46. The apparatus for minimizing artifacts in speech according to claim 44, wherein said means for time-warping said frame comprises means for interpolating from one pitch period to another to obtain interpolated pitch periods of an expanded residual signal of said frame.

47. The apparatus for minimizing artifacts in speech according to claim 35, said apparatus comprising means for inserting an erasure in the decoded signal at the expected frame, wherein said means for decoding a received frame comprises means for discarding samples of said frame such that a phase at an end of said frame as decoded matches with said phase for matching, and wherein the phase for matching is based on a phase at an end of said erasure.

48. The apparatus for minimizing artifacts in speech according to claim 47, wherein said means for decoding a received frame includes means for time-warping said frame.

49. The apparatus for minimizing artifacts in speech according to claim 48, wherein said means for time-warping said frame comprises means for interpolating from one pitch period to another to obtain interpolated pitch periods of an expanded residual signal of said frame.

50. The apparatus for minimizing artifacts in speech according to claim 35, wherein said means for decoding a received frame includes means for time-warping said frame.

51. A method of audio signal processing, said method comprising performing each of the following acts within a device that is configured to process audio signals:

detecting that an expected frame of a signal being decoded is absent from a buffer;

based on a phase of the decoded signal at the expected frame, obtaining a phase for matching; and decoding a received frame that is subsequent in the signal being decoded to the expected frame and encodes a frame having a length of n samples, wherein said decoding the received frame includes:

generating a signal having a total length of m samples from the received frame, where m is less than n and is based on the phase for matching, by decoding said frame at an offset from a beginning of said frame, such that a first sample of the decoded frame is phase-matched to the phase for matching; and wherein the phase for matching is based on a phase at the end of a decoded frame that is prior to the expected frame; and time-warping the generated signal to produce a modified residual signal for the received frame such that the modified residual signal has more than m samples.

52. The method of audio signal processing according to claim 51, wherein said decoding said frame at an offset comprises discarding initial impulses of a fixed codebook for the received frame to obtain a shifted fixed codebook for the received frame, and wherein the generated signal is based on the shifted fixed codebook.

53. The method of audio signal processing according to claim 51, wherein said decoding the received frame comprises calculating a difference between an encoder phase and said phase for matching, and wherein m is based on said calculated difference.

54. The method of audio signal processing according to claim 51, wherein the phase for matching is based on a phase at the end of a decoded frame that is prior to the expected frame.

* * * * *